US009357305B2

(12) United States Patent
Kuech et al.

(10) Patent No.: US 9,357,305 B2
(45) Date of Patent: May 31, 2016

(54) APPARATUS FOR GENERATING AN ENHANCED DOWNMIX SIGNAL, METHOD FOR GENERATING AN ENHANCED DOWNMIX SIGNAL AND COMPUTER PROGRAM

(75) Inventors: Fabian Kuech, Erlangen (DE); Juergen Herre, Buckenhof (DE); Christof Faller, Greifensee (CH); Christophe Tournery, Penthaz (CH)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 698 days.

(21) Appl. No.: 13/592,977

(22) Filed: Aug. 23, 2012

(65) Prior Publication Data

US 2013/0216047 A1 Aug. 22, 2013

Related U.S. Application Data

(63) Continuation of application No. PCT/EP2011/052246, filed on Feb. 15, 2011.

(60) Provisional application No. 61/307,553, filed on Feb. 24, 2010.

(51) Int. Cl.
*H04R 5/00* (2006.01)
*G10L 19/008* (2013.01)
(Continued)

(52) U.S. Cl.
CPC ..... *H04R 5/00* (2013.01); *G10L 19/008* (2013.01); *G10L 19/265* (2013.01); *G10L 21/02* (2013.01)

(58) Field of Classification Search
CPC ..... G01L 19/008; H04R 5/027
USPC ..... 381/23, 18, 22, 61, 63, 98, 26, 119, 92, 381/116; 700/94; 704/501, 500, 200.1, 203, 704/219
See application file for complete search history.

(56) References Cited

U.S. PATENT DOCUMENTS 5,307,405 A 4/1994 Sih
5,511,093 A 4/1996 Edler et al.
(Continued)

FOREIGN PATENT DOCUMENTS

CN 1647155 A 7/2005
CN 1930608 A 3/2007
(Continued)

OTHER PUBLICATIONS

Official Communication issued in corresponding Japanese Patent Application No. 2012-554287, mailed on Jul. 30, 2013.
(Continued)

*Primary Examiner* — Davetta W Goins
*Assistant Examiner* — Kuassi Ganmavo
(74) *Attorney, Agent, or Firm* — Keating & Bennett, LLP

(57) ABSTRACT

An apparatus for generating an enhanced downmix signal on the basis of a multi-channel microphone signal has a spatial analyzer configured to compute a set of spatial cue parameters having a direction information describing a direction-of-arrival of a direct sound, a direct sound power information and a diffuse sound power information on the basis of the multi-channel microphone signal. The apparatus also has a filter calculator for calculating enhancement filter parameters in dependence on the direction information describing the direction-of-arrival of the direct sound, in dependence on the direct sound power information and in dependence on the diffuse sound power information. The apparatus also has a filter for filtering the microphone signal, or a signal derived therefrom, using the enhancement filter parameters, to obtain the enhanced downmix signal.

18 Claims, 7 Drawing Sheets

(51) Int. Cl.

| | |
|---|---|
| ***G10L 19/26*** | (2013.01) |
| ***G10L 21/02*** | (2013.01) |

(56) References Cited

U.S. PATENT DOCUMENTS

| | | | | |
|---|---|---|---|---|
| 5,559,881 | A | 9/1996 | Sih | |
| 5,646,991 | A | 7/1997 | Sih | |
| 5,687,229 | A | 11/1997 | Sih | |
| 5,978,473 | A | 11/1999 | Rasmusson | |
| 6,973,184 | B1 | 12/2005 | Shaffer et al. | |
| 7,583,805 | B2 | 9/2009 | Baumgarte et al. | |
| 7,644,003 | B2 | 1/2010 | Baumgarte et al. | |
| 7,945,055 | B2 | 5/2011 | Taleb et al. | |
| 8,340,302 | B2 | 12/2012 | Breebaart et al. | |
| 8,538,031 | B2 | 9/2013 | Purnhagen et al. | |
| 2005/0078831 | A1* | 4/2005 | Irwan et al. | 381/1 |
| 2006/0239464 | A1* | 10/2006 | Lee et al. | 381/1 |
| 2007/0269063 | A1* | 11/2007 | Goodwin et al. | 381/310 |
| 2009/0110203 | A1 | 4/2009 | Taleb | |
| 2009/0252339 | A1* | 10/2009 | Obata et al. | 381/18 |
| 2009/0326689 | A1 | 12/2009 | Allard | |
| 2010/0061558 | A1* | 3/2010 | Faller | 381/23 |
| 2010/0174548 | A1* | 7/2010 | Beack et al. | 704/503 |
| 2011/0286609 | A1* | 11/2011 | Faller | 381/92 |
| 2011/0298322 | A1 | 12/2011 | Sherwin et al. | |
| 2012/0046940 | A1* | 2/2012 | Tsujikawa et al. | 704/200 |
| 2012/0114126 | A1 | 5/2012 | Thiergart et al. | |

FOREIGN PATENT DOCUMENTS

| | | | |
|---|---|---|---|
| CN | 101124740 | A | 2/2008 |
| EP | 1 565 036 | A2 | 8/2005 |
| EP | 1 803 325 | B1 | 11/2008 |
| JP | 2004-289762 | A | 10/2004 |
| JP | 2011-526399 | A | 10/2011 |
| JP | 2012-509049 | A | 4/2012 |
| JP | 2012-526296 | A | 10/2012 |
| RU | 2 109 408 | C1 | 4/1998 |
| RU | 2 180 984 | C2 | 3/2002 |
| WO | WO 2004084577 | A1 * | 9/2004 |
| WO | 2007/110101 | A1 | 10/2007 |
| WO | 2009/156906 | A1 | 12/2009 |

OTHER PUBLICATIONS

Kallinger et al., "Spatial Filtering Using Directional Audio Coding Parameters," Proc. ICASSP 2009, pp. 217-220.

"Information Technology—MPEG Audio Technologies—Part 1: MPEG Surround," International Standards Organization, ISO/IEC FDIS 23003-1:2006, Jul. 21, 2006, Geneva, Switzerland, 289 pages.

Gerzon, "Periphony: With-Height Sound Reproduction," Journal of the Audio Engineering Society, vol. 21, No. 1, Jan./Feb. 1973, pp. 2-10.

Griesinger, "Stereo and Surround Panning in Practice," Audio Engineering Society,112th Convention Paper 5564, May 10-13, 2002, pp. 1-6, Munich, Germany.

Haykin, "Adaptive Filter Theory Third Edition," Prentice Hall, 1996, 48 pages.

Herre et al., "MPEG Surround—The ISO/MPEG Standard for Efficient and Compatible Mullti-Channel Audio Coding," Audio Engineering Society, 122nd Convention Paper 7084, May 5-8, 2007, Vienna, Austria.

Pulkki, "Virtual Sound Source Positioning Using Vector Base Amplitude Panning," Journal of Audio Engineering Society, vol. 45, No. 6, Jun. 1997, pp. 456-466.

Van Veen et al., "Beamforming: A Versatile Approach to Spatial Filtering," IEEE ASSP Magazine, Apr. 1988, pp. 4-24.

Official Communication issued in corresponding Japanese Patent Application No. 2012-554287, mailed on Feb. 25, 2014.

Official Communication issued in International Patent Application No. PCT/EP2011/052246, mailed on Mar. 28, 2011.

Faller, "Microphone Front-Ends for Spatial Audio Coders," Audio Engineering Society Convention Paper 7508, 125th Convention, Oct. 2-5, 2008, pp. 1-10, San Francisco, CA.

* cited by examiner

APPARATUS FOR GENERATING AN ENHANCED DOWNMIX SIGNAL, METHOD FOR GENERATING AN ENHANCED DOWNMIX SIGNAL AND COMPUTER PROGRAM

CROSS-REFERENCE TO RELATED APPLICATIONS

This application is a continuation of copending International Application No. PCT/EP2011/052246, filed Feb. 15, 2011, which is incorporated herein by reference in its entirety, and additionally claims priority from U.S. Application No. 61/307,553, filed Feb. 24, 2010, which is also incorporated herein by reference in its entirety.

BACKGROUND OF THE INVENTION

Embodiments according to the invention are related to an apparatus for generating an enhanced downmix signal, to a method for generating an enhanced downmix signal and to a computer program for generating an enhanced downmix signal.

An embodiment according to the invention is related to an enhanced downmix computation for spatial audio microphones.

Recording surround sound with a small microphone configuration remains a challenge. One of the most widely known such configuration is a Soundfield microphone and corresponding surround decoders (see, for example, reference [3]), which filter and combine its four nearly-coincident microphone capsule signals to generate the surround sound output channels. While high single channel signal fidelity is maintained, the weakness of this approach is its limited channel separation related to limited directivity of first order microphone directional responses.

Alternatively, techniques based on a parametric representation of the observed sound field can be applied. In reference [2], a method has been proposed using conventional coincident stereo microphone pairs to record surround sound. It was shown how to estimate the spatial cue parameters direct-to-diffuse-sound-ratios and directions-of-arrival of sound from these directional microphone signals and how to apply this information to drive a spatial audio coding synthesis to generate surround sound. In reference [2] it has also been discussed, how the parametric information, i.e., direction-of-arrival (DOA) of sound and the diffuse-sound-ratio (DSR) of the sound field can be used to directly computing the specific spatial parameters that are used in MPEG Surround (MPS) coding scheme (see, for example, reference [6]).

MPEG Surround is parametric representation of multi-channel audio signals, representing an efficient approach to high-quality spatial audio coding. MPS exploits the fact that, from a perceptual point of view, multi-channel audio signals contain significant redundancy with respect to the different loudspeaker channels. The MPS encoder takes multiple loudspeaker signals as input, where the corresponding spatial configuration of the loudspeakers has to be known in advance. Based on these input signals, the MPS encoder computes spatial parameters in frequency subbands, such as channel level differences (CLD) between two channels and inter channel correlation (ICC) between two channels. The actual MPS side information is then derived from these spatial parameters. Furthermore, the encoder computes a downmix signal, which could consist of one or more audio channels.

It has been found out that the stereo microphone input signals are well suitable to estimate the spatial cue parameters. However, it has also been found out that the unprocessed stereo microphone input signal is in general not well suitable to be directly used as the corresponding MPEG Surround downmix signal. It has been found that in many cases, crosstalk between left and right channels is too high, resulting in a poor channel separation in the MPEG Surround decoded signals.

In view of this situation, there is a need for a concept for generating an enhanced downmix signal on the basis of a multi-channel microphone signal, such that the enhanced downmix signals leads to a sufficiently good spatial audio quality and localization property after MPEG Surround decoding.

SUMMARY

According to an embodiment, an apparatus for generating an enhanced downmix signal on the basis of a multi-channel microphone signal may have a spatial analyzer configured to compute a set of spatial cue parameters having a direction information describing a direction-of-arrival of direct sound, a direct sound power information and a diffuse sound power information, on the basis of the multi-channel microphone signal; a filter calculator for calculating enhancement filter parameters in dependence on the direction information describing the direction-of-arrival of the direct sound, in dependence on the direct sound power information and in dependence on the diffuse sound power information; and a filter for filtering the microphone signal, or a signal derived therefrom, using the enhancement filter parameters, to acquire the enhanced downmix signal; wherein the filter calculator is configured to calculate the enhancement filter parameters in dependence on direction-dependent gain factors which describe desired contributions of a direct sound component of the multi-channel microphone signal to a plurality of loudspeaker signals and in dependence on one or more downmix matrix values which describe desired contributions of a plurality of audio channels to one or more channels of the enhanced downmix signal.

According to another embodiment, a method for generating an enhanced downmix signal on the basis of a multi-channel microphone signal may have the steps of computing a set of spatial cue parameters having a direction information describing a direction-of-arrival of a direct sound, a direct sound power information and a diffuse sound power information on the basis of the multi-channel microphone signal; calculating enhancement filter parameters in dependence on the direction information describing the direction-of-arrival of the direct sound, in dependence on the direct sound power information and in dependence on the diffuse sound power information; and filtering the microphone signal, or a signal derived therefrom, using the enhancement filter parameters, to acquire the enhanced downmix signal; wherein the enhancement filter parameters are calculated in dependence on direction-dependent gain factors which describe desired contributions of a direct sound component of the multi-channel microphone signal to a plurality of loudspeaker signals and in dependence on one or more downmix matrix values which describe desired contributions of a plurality of audio channels to one or more channels of the enhanced downmix signal.

According to another embodiment, an apparatus for generating an enhanced downmix signal on the basis of a multi-channel microphone signal may have a spatial analyzer configured to compute a set of spatial cue parameters having a direction information describing a direction-of-arrival of direct sound, a direct sound power information and a diffuse sound power information, on the basis of the multi-channel microphone signal; a filter calculator for calculating enhancement filter parameters in dependence on the direction information describing the direction-of-arrival of the direct sound, in dependence on the direct sound power information and in dependence on the diffuse sound power information; and a filter for filtering the microphone signal, or a signal derived therefrom, using the enhancement filter parameters, to acquire the enhanced downmix signal; wherein the filter calculator is configured to selectively perform a single-channel filtering, in which a first channel of the enhanced downmix signal is derived by a filtering of a first channel of the multi-channel microphone signal and in which a second channel of the enhanced downmix signal is derived by a filtering of a second channel of the multi-channel microphone signal while avoiding a cross talk from the first channel of the multi-channel microphone signal to the second channel of the enhanced downmix signal and from the second channel of the multi-channel microphone signal to the first channel of the enhanced downmix signal, or a two-channel filtering in which a first channel of enhanced downmix signal is derived by filtering a first and a second channel of the multi-channel microphone signal, and in which a second channel of the enhanced downmix signal is derived by filtering a first and a second channel of the multi-channel microphone signal, in dependence on a correlation value describing a correlation between the first channel of the multi-channel microphone signal and the second channel of the multi-channel microphone signal.

According to another embodiment, a method for generating an enhanced downmix signal on the basis of a multi-channel microphone signal may have the steps of computing a set of spatial cue parameters having a direction information describing a direction-of-arrival of a direct sound, a direct sound power information and a diffuse sound power information on the basis of the multi-channel microphone signal; calculating enhancement filter parameters in dependence on the direction information describing the direction-of-arrival of the direct sound, in dependence on the direct sound power information and in dependence on the diffuse sound power information; and filtering the microphone signal, or a signal derived therefrom, using the enhancement filter parameters, to acquire the enhanced downmix signal; wherein the method has selectively performing a single-channel filtering, in which a first channel of the enhanced downmix signal is derived by a filtering of a first channel of the multi-channel microphone signal and in which a second channel of the enhanced downmix signal is derived by a filtering of a second channel of the multi-channel microphone signal while avoiding a cross talk from the first channel of the multi-channel microphone signal to the second channel of the enhanced downmix signal and from the second channel of the multi-channel microphone signal to the first channel of the enhanced downmix signal, or a two-channel filtering in which a first channel of enhanced downmix signal is derived by filtering a first and a second channel of the multi-channel microphone signal, and in which a second channel of the enhanced downmix signal is derived by filtering a first and a second channel of the multi-channel microphone signal, in dependence on a correlation value describing a correlation between the first channel of the multi-channel microphone signal and the second channel of the multi-channel microphone signal.

An embodiment may have one of the above-mentioned methods for generating an enhanced downmix signal on the basis of a multi-channel microphone signal.

An embodiment according to the invention creates an apparatus for generating an enhanced downmix signal on the basis of a multi-channel microphone signal. The apparatus comprises a spatial analyzer configured to compute a set of spatial cue parameters comprising a direction information describing a direction-of-arrival of direct sound, a direct sound power information and a defuse sound power information on the basis of the multi-channel microphone signal. The apparatus also comprises a filter calculator for calculating enhancement filter parameters in dependence on the direction information describing the direction-of-arrival of the direct sound, in dependence on the direct sound power information and in dependence on the diffuse sound power information. The apparatus also comprises a filter for filtering the microphone signal, or a signal derived therefrom, using the enhancement filter parameters, to obtain the enhanced downmix signal.

This embodiment according to the invention is based on the finding that an enhanced downmix signal, which is better-suited than the input multi-channel microphone signal, can be derived from the input multi-channel microphone signal by a filtering operation, and that the filter parameters for such a signal enhancement filtering operation can be derived efficiently from the spatial cue parameters.

Accordingly, it is possible to reuse the same information, namely the spatial cue parameters, which is also well-suited for the derivation of the MPEG Surround parameters, for the computation of the enhancement filter parameters. Accordingly, a highly-efficient system can be created using the above-described concept.

Moreover, it is possible to derive a downmix signal, which allows for a good channel separation when processed in an MPEG surround decoder even if the channel signals of the multi-channel microphone signal only comprise a low spatial separation. Accordingly, the enhanced downmix signal may lead to a significantly improved spatial audio quality and localization property after MPEG Surround decoding compared to conventional systems.

To summarize, the above-described embodiment according to the invention allows to provide an enhanced downmix signal having good spatial separation properties at moderate computational effort.

In an embodiment, the filter calculator is configured to calculate the enhancement filter parameters such that the enhanced downmix signal approximates a desired downmix signal. Using this approach, it can be ensured that the enhancement filter parameters are well-adapted to a desired result of the filtering. For example, enhancement filter parameters can be calculated such that one or more statistical properties of the enhanced downmix signal approximate desired statistical properties of the downmix signal. Accordingly, it can be reached that the enhanced downmix signal is well-adapted to the expectations, wherein the expectations can be defined numerically in terms of desired correlation values.

In an embodiment, the filter calculator is configured to calculate desired correlation values between the multi-channel microphone signal (or, more precisely, channel signals thereof) and desired channel signals of the downmix signal in dependence on the spatial cue parameters. In this case, the filter calculator is advantageously configured to calculate the enhancement filter parameters in dependence on the desired cross-correlation values. It has been found that said cross-correlation values are a good measure of whether the channel signals of the downmix signal exhibit sufficiently good channel separation characteristics. Also, it has been found that the desired correlation values can be computed with moderate computational effort on the basis of the spatial cue parameters.

In an embodiment, the filter calculator is configured to calculate the desired cross-correlation values in dependence on direction-dependent gain factors, which describe desired contributions of a direct sound component of the multi-channel microphone signal to a plurality of loudspeaker signals, and in dependence on one or more downmix matrix values which describe desired contributions of a plurality of audio channels (for example, loudspeaker signals) to one or more channels of the enhanced downmix signal. It has been found that both the direction-dependent gain factors and the downmix matrix values are very well-suited for computing the desired cross-correlation values and that said direction-dependent gain factors and said downmix matrix values are easily obtainable. Moreover, it has been found that the desired cross-correlation values are easily obtainable on the basis of said information.

In an embodiment, the filter calculator is configured to map the direction information onto a set of direction-dependent gain factors. It has been found that a multi-channel amplitude panning law may be used to determine the gain factors with moderate effort in dependence on the direction information. It has been found that the direction-of-arrival information is well-suited to determine the direction-dependent gain factors, which may describe, for example, which speakers should render the direct sound component. It is easily understandable that the direct sound component is distributed to different speaker signals in dependence on the direction-of-arrival information (briefly designated as direction information), and that it is relatively simple to determine the gain factors which describe which of the speakers should render the direct sound component. For example, the mapping rule, which is used for mapping the direction information onto the set of direction-dependent gain factors, may simply determine that those speakers, which are associated to the direction of arrival, could render (or mainly render) the direct sound component, while the other speakers, which are associated with other directions, should only render a small portion of the direct sound component or should even suppress the direct sound component.

In an embodiment, the filter calculator is configured to consider the direct sound power information and the diffuse sound power information to calculate the desired cross-correlation values. It has been found that the consideration of the powers of both of said sound components (direct sound component and diffuse sound component) results in a particularly good hearing impression, because both the direct sound component and the diffuse sound component can be properly allocated to the channel signals of the (typically multi-channel) downmix signal.

In an embodiment, the filter calculator is configured to weight the direct sound power information in dependence on the direction information, and to apply a predetermined weighting, which is independent from the direction information, to the diffuse sound power information, in order to calculate the desired cross-correlation values. Accordingly, it can be distinguished between the direct sound components and the diffuse sound components, which results in a particularly realistic estimation of the desired cross-correlation values.

In an embodiment, the filter calculator is configured to evaluate a Wiener-Hopf equation to derive the enhancement filter parameters. In this case, the Wiener-Hopf equation describes a relationship between correlation values describing a correlation between different channel pairs of the multi-channel microphone signal, enhancement filter parameters and desired cross-correlation values between channel signals of the multi-channel microphone signal and desired channel signals of the downmix signal. It has been found that the evaluation of such a Wiener-Hopf equation results in enhancement filter parameters which are well-adapted to the desired correlation characteristics of the channel signals of the downmix signal.

In an embodiment, the filter calculator is configured to calculate the enhancement filter parameters in dependence on a model of desired downmix channels. By modeling the desired downmix channels, the enhancement filter parameters can be computed such that they yield a downmix signal which allows for a good reconstruction of desired multi-channel speaker signals in a multi-channel decoder.

In some embodiments, the model of the desired downmix channels may comprise a model of an ideal downmixing, which would be performed if the channel signals (for example, loudspeaker signals) were available individually. Moreover, the modeling may include a model of how individual channel signals could be obtained from the multi-channel microphone signal, even if the multi-channel microphone signal comprises channel signals having only a limited spatial separation. Accordingly, an overall model of the desired downmix channels can be obtained, for example, by combining a modeling of how to obtain individual channel signals (for example, loudspeaker signals) and how to derive desired downmix channels from said individual channel signals. Thus, it is a sufficiently good reference for the calculation of the enhancement filter parameters obtainable with relatively small computational effort.

In an embodiment, the filter calculator is configured to selectively perform a single-channel filtering, in which a first channel of the downmix signal is derived by a filtering of a first channel of the multi-channel microphone signal and in which a second channel of the downmix signal is derived by a filtering of a second channel of the multi-channel microphone signal while avoiding a cross talk from the first channel of the multi-channel microphone signal to the second channel of the downmix signal and from the second channel of the multi-channel microphone signal to the first channel of the downmix signal, or a two-channel filtering, in which a first channel of the downmix signal is derived by filtering a first and a second channel of the multi-channel microphone signal, and in which a second channel of the downmix signal is derived by filtering a first and a second channel of the multi-channel microphone signal. The selection of the single-channel filtering and of the two-channel filtering is made in dependence on a correlation value describing a correlation between the first channel of the multi-channel microphone signal and the second channel of the multi-channel microphone signal. By selecting between the single-channel filtering and the two-channel filtering, numeric errors can be avoided which may sometimes appear if the two-channel filtering is used in a situation in which the left and right channel are highly correlated. Accordingly, a good-quality downmix signal can be obtained irrespective of whether the channel signals of the multi-channel microphone signal are highly correlated or not.

Another embodiment according to the invention creates a method for generating an enhanced downmix signal.

Another embodiment according to the invention creates a computer program for performing said method for generating an enhanced downmix signal.

The method and the computer program are based on the same findings as the apparatus and may be supplemented by any of the features and functionalities discussed with respect to the apparatus.

BRIEF DESCRIPTION OF THE DRAWINGS

Embodiments according to the present invention will subsequently be described taking reference to the enclosed figures in which.

DETAILED DESCRIPTION OF THE INVENTION

1. Apparatus for Generating an Enhanced Downmix Signal According to FIG. 1

Figure 1:
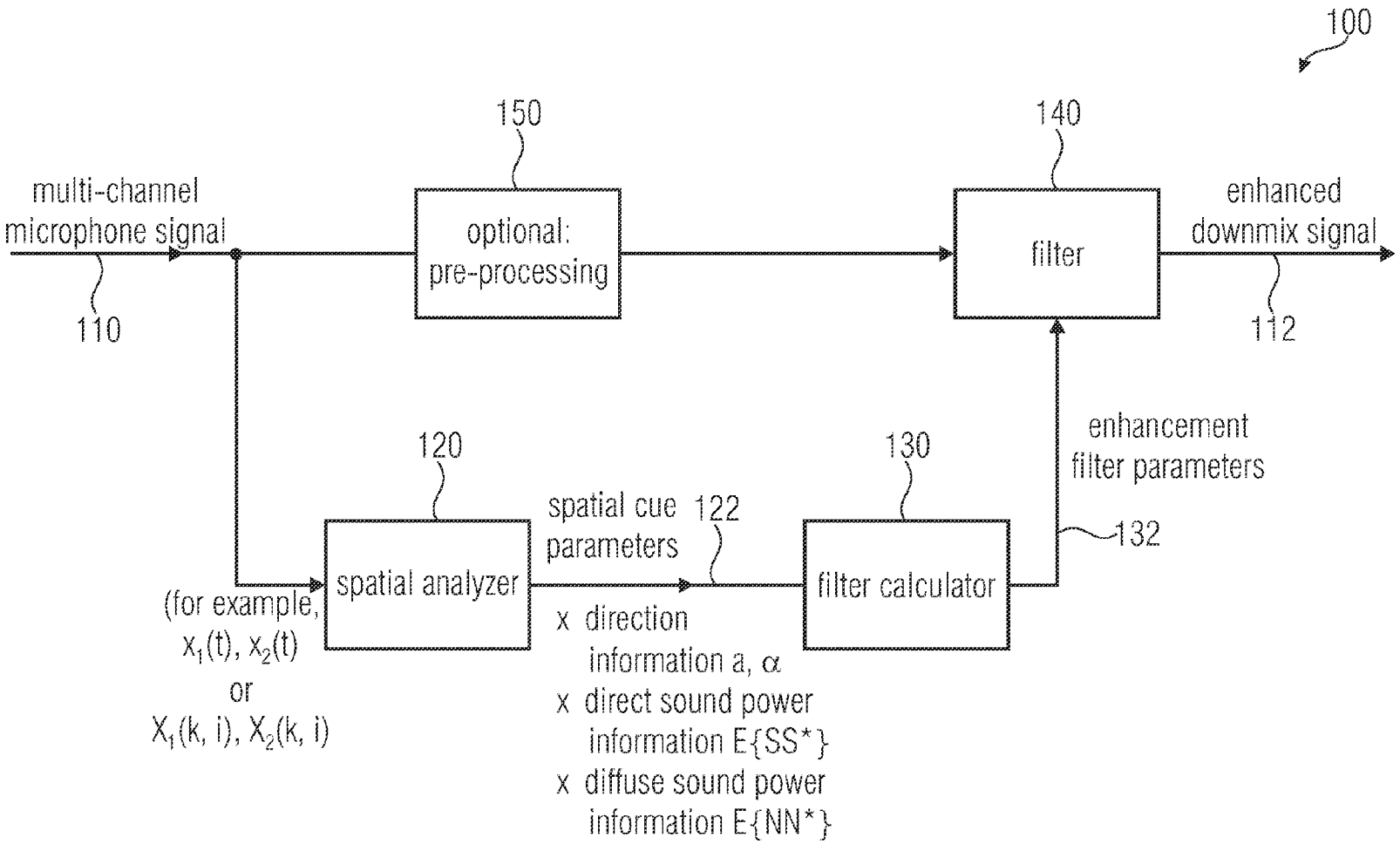
FIG. 1 shows a block schematic diagram of an apparatus for generating an enhanced downmix signal, according to an embodiment of the invention.

FIG. 1 shows a block schematic diagram of an apparatus 100 for generating an enhanced downmix signal on the basis of a multi-channel microphone signal. The apparatus 100 is configured to receive a multi-channel microphone signal 110 and to provide, on the basis thereof, an enhanced downmix signal 112. The apparatus 100 comprises a spatial analyzer 120 configured to compute a set of spatial cue parameters 122 on the basis of the multi-channel microphone signal 110. The spatial cue parameters typically comprise a direction information describing a direction-of-arrival of direct sound (which direct sound is included in the multi-channel microphone signal), a direct sound power information and a diffuse sound power information. The apparatus 100 also comprises a filter calculator 130 for calculating enhancement filter parameters 132 in dependence on the spatial cue parameters 122, i.e., in dependence on the direction information describing the direction-of-arrival of direct sound, in dependence on the direct sound power information and in dependence on the diffuse sound power information. The apparatus 100 also comprises a filter 140 for filtering the microphone signal 110, or a signal 110' derived therefrom, using the enhancement filter parameters 132, to obtain the enhanced downmix signal 112. The signal 110' may optionally be derived from the multi-channel microphone signal 110 using an optional preprocessing 150.

Regarding the functionality of the apparatus 100, it can be noted that the enhanced downmix signal 112 is typically provided such that the enhanced downmix signal 112 allows for an improved spatial audio quality after MPEG Surround decoding when compared to the multi-channel microphone signal 110, because the enhancement filter parameters 132 are typically provided by the filter calculator 130 in order to achieve this objective. The provision of the enhancement filter parameters 130 is based on the spatial cue parameters 122 provided by the spatial analyzer, such that the enhancement filter parameters 130 are provided in accordance with a spatial characteristic of the multi-channel microphone signal 110, and in order to emphasize the spatial characteristic of the multi-channel microphone signal 110. Accordingly, the filtering performed by the filter 140 allows for a signal-adaptive improvement of the spatial characteristic of the enhanced downmix signal 112 when compared to the input multi-channel microphone signal 110.

Details regarding the spatial analysis performed by the spatial analyzer 120, with respect to the filter parameter calculation performed by the filter calculator 130 and with respect to the filtering performed by the filter 140 will subsequently be described in more detail.

2. Apparatus for Generating an Enhanced Downmix Signal According to FIG. 2

Figure 2:
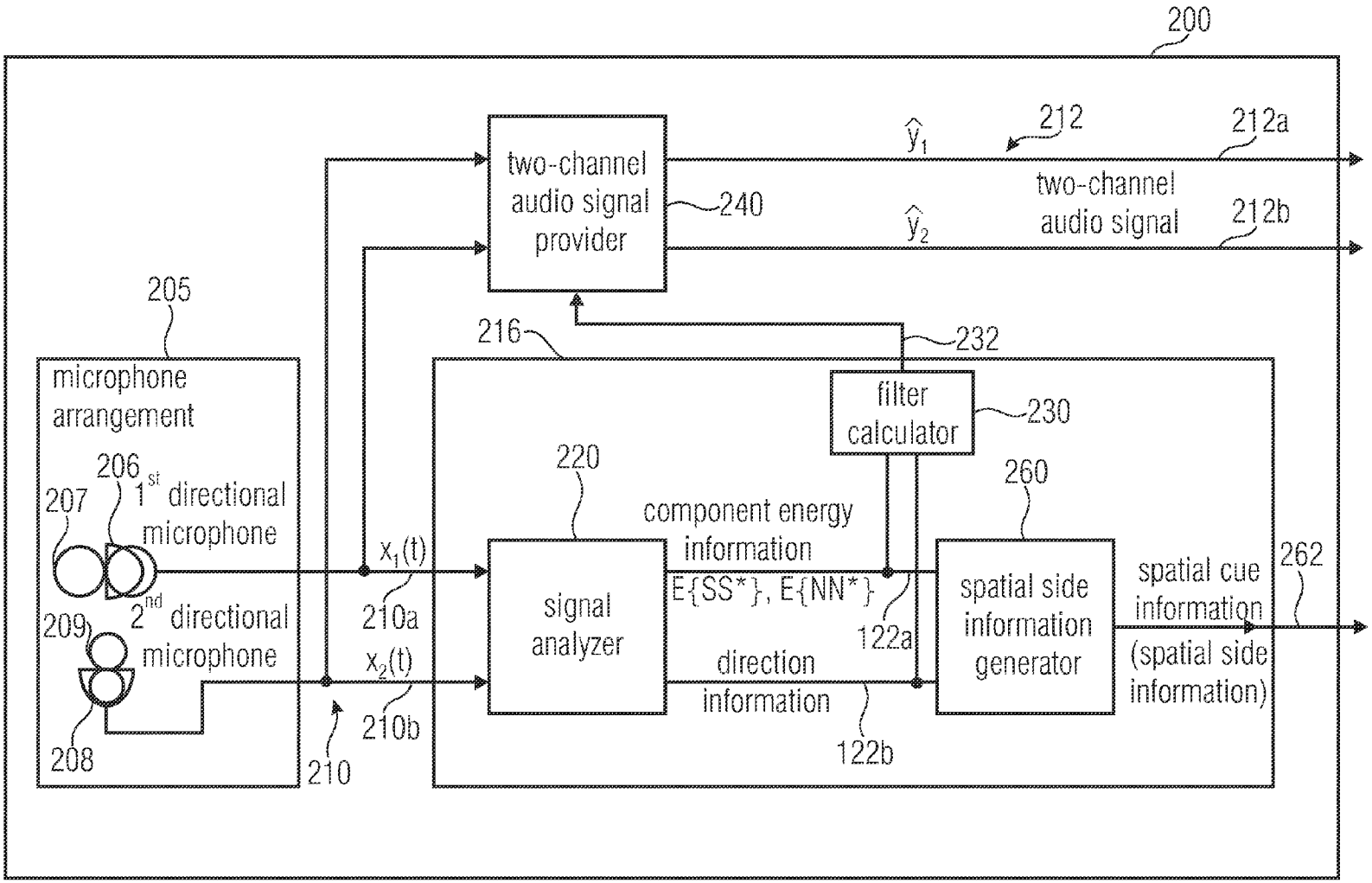
FIG. 2 shows a graphic illustration of the spatial audio microphone processing, according to an embodiment of the invention.

FIG. 2 shows a block schematic diagram of an apparatus 200 for generating an enhanced downmix signal (which may take the form of a two-channel audio signal) and a set of spatial cues associated with an upmix signal having more than two channels. The apparatus 200 comprises a microphone arrangement 205 configured to provide a two-channel microphone signal comprising a first channel signal 210*a* and a second channel signal 210*b*.

The apparatus 200 further comprises a processor 216 for providing a set of spatial cues associated with an upmix signal having more than two channels on the basis of a two-channel microphone signal. The processor 216 is also configured to provide enhancement filter parameters 232. The processor 216 is configured to receive, as its input signals, the first channel signal 210*a* and the second channel signal 210*b* provided by the microphone arrangement 205. The apparatus 216 is configured to provide the enhancement filter parameters 232 and to also provide a spatial cue information 262. The apparatus 200 further comprises a two-channel audio signal provider 240, which is configured to receive the first channel signal 210*a* and the second channel signal 210*b* provided by the microphone arrangement 205 and to provide processed versions of the first channel microphone signal 210*a* and of the second channel microphone signal 210*b* as the two-channel audio signal 212 comprising channel signals 212*a*, 212*b*.

The microphone arrangement 205 comprises a first directional microphone 206 and a second directional microphone 208. The first directional microphone 206 and the second directional microphone 208 are advantageously spaced by no more than 30 cm. Accordingly, the signals received by the first directional microphone 206 and the second directional microphone 208 are strongly correlated, which has been found to be beneficial for the calculation of a component energy information (or component power information) 122*a* and a direction information 122*b* by the signal analyzer 220. However, the first directional microphone 206 and the second directional microphone 208 are oriented such that a directional characteristic 209 of the second directional microphone 208 is a rotated version of a directional characteristic 207 of the first directional microphone 206. Accordingly, the first channel microphone signal 210*a* and the second channel microphone signal 210*b* are strongly correlated (due to the spatial proximity of the microphones 206, 208) yet different (due to the different directional characteristics 207, 209 of the directional microphones 206, 208). In particular, a directional signal incident on the microphone arrangement 205 from an approximately constant direction causes strongly correlated signal components of the first channel microphone signal 210*a* and the second channel microphone signal 210*b* having a temporally constant direction-dependent amplitude ratio (or intensity ratio). An ambient audio signal incident on the microphone array 205 from temporally-varying directions causes signal components of the first channel microphone signal 210*a* and the second channel microphone signal 210*b* having a significant correlation, but temporally fluctuating amplitude ratios (or intensity ratios). Accordingly, the microphone arrangement 205 provides a two-channel microphone signal 210*a*, 210*b*, which allows the signal analyzer 220 of the processor 216 to distinguish between direct sound and diffuse sound even though the microphones 206, 208 are closely spaced. Thus, the apparatus 200 constitutes an audio signal provider, which can be implemented in a spatially compact form, and which is, nevertheless, capable of providing spatial cues associated with an upmix signal having more than two channels.

The spatial cues 262 can be used in combination with the provided two-channel audio signal 212*a*, 212*b* by a spatial audio decoder to provide a surround sound output signal.

In the following, some further explanations regarding the apparatus 200 will be given. The apparatus 200 optionally comprises a microphone arrangement 205, which provides the first channel signal 210*a* and the second channel signal 210*b*. The first channel signal 210*a* is also designated with $x_1$ (t) and the second channel signal 210*b* is also designated with $x_2$ (t). It should also be noted that the first channel signal 210*a* and the second channel signal 210*b* may represent the multi-channel microphone signal 110, which is input into the apparatus 100 according to FIG. 1.

The two-channel audio signal provider 240 receives the first channel signal 210*a* and the second channel signal 210*b* and typically also receives the enhancement filter parameter information 232. The two-channel audio signal provider 240 may, for example, perform the functionality of the optional pre-processing 150 and of the filter 140, to provide the two channel audio signal 212 which is represented by a first channel signal 212*a* and a second channel signal 212*b*. The two-channel audio signal 212 may be equivalent to the enhanced downmix signal 112 output by the apparatus 100 of FIG. 1.

The signal analyzer 220 may be configured to receive the first channel signal 210*a* and the second channel signal 210*b*. Also, the signal analyzer 220 may be configured to obtain a component energy information 122*a* and a direction information 122*b* on the basis of the two-channel microphone signal 210, i.e., on the basis of the first channel signal 210*a* and the second channel signal 210*b*. Advantageously, the signal analyzer 220 is configured to obtain the component energy information 122*a* and the direction information 122*b* such that the component energy information 122*a* described estimates of energies (or, equivalently, of powers) of a direct sound component of the two-channel microphone signal and of a diffuse sound component of the two-channel microphone signal, and such that the direction information 122 describes an estimate of a direction from which the direct sound component of the two-channel microphone signal 210*a*, 210*b* originates. Accordingly, the signal analyzer 220 may take the functionality of the spatial analyzer 120, and the component energy information 122*a* and the direction information 122*b* may be equivalent to the spatial cue parameters 122. The component energy information 122*a* may be equivalent to the direct sound power information and the diffuse sound power information. The processor 216 also comprises the spatial side information generator 260 which receives the component energy information 122*a* and the direction information 122*b* from the signal analyzer 220. The spatial side information generator 260 is configured to provide, on the basis thereof, the spatial cue information 262. Advantageously, the spatial side information generator 260 is configured to map the component energy information 122*a* of the two-channel microphone signal 210*a*, 210*b* and the direction information 122*b* of the two-channel microphone signal 210*a*, 210*b* onto the spatial cue information 262. Accordingly, the spatial side information 262 is obtained such that the spatial cue information 262 describes a set of spatial cues associated with an upmix audio signal having more than two channels.

The processor 216 allows for a computationally very efficient computation of the spatial cue information 262, which is associated with an upmix audio signal having more than two channels, on the basis of a two-channel microphone signal 210*a*, 210*b*. The signal analyzer 220 is capable of extracting a large amount of information from the two-channel microphone signal, namely the component energy information 122*a* describing both an estimate of an energy of a direct sound component and an estimate of an energy of a diffuse sound component, and the direction information 122*b* describing an estimate of a direction from which the direct sound component of the two-channel microphone signal originates. It has been found that this information, which can be obtained by the signal analyzer 220 on the basis of the two-channel microphone signal 210*a*, 210*b*, is sufficient to derive the spatial cue information 262 even for an upmix audio signal having more than two channels. Importantly, it has been found that the component energy information 122*a* and the direction information 122*b* are sufficient to directly determine the spatial cue information 262 without actually using the upmix audio channels as an intermediate quantity.

Moreover, the processor 216 comprises a filter calculator 230 which is configured to receive the component energy information 122*a* and the direction information 122*b* and to provide, on the basis thereof, the enhancement filter parameter information 232. Accordingly, the filter calculator 230 may take over the functionality of the filter calculator 130.

To summarize the above, the apparatus 200 is capable to efficiently determine both the enhanced downmix signal 212 and the spatial cue information 262 in an efficient way, using the same intermediate information 122*a*, 122*b* in both cases. Also, it should be noted that the apparatus 200 is capable of using a spatially small microphone arrangement 205 in order to obtain both the (enhanced) downmix signal 212 and the spatial cue information 262. The downmix signal 212 comprises a particularly good spatial separation characteristic, despite the usage of the small microphone arrangement 205 (which may be part of the apparatus 200 or which may be external to the apparatus 200 but connected to the apparatus 200) because of the computation of the enhancement filter parameters 232 by the filter calculator 230. Accordingly, the (enhanced) downmix signal 212 may be well-suited for a spatial rendering (for example, using an MPEG Surround decoder) when taken in combination with the spatial cue information 262.

To summarize, FIG. 2 shows a block schematic diagram of a spatial audio microphone approach. As can be seen, the stereo microphone input signals 210*a* (also designated with $x_1$ (t)) and 210*b* (also designated with $x_2$ (t)) are used in the block 216 to compute the set of spatial cue information 262 associated with a multi-channel upmix signal (for example, the two-channel audio signal 212). Furthermore, a two-channel downmix signal 212 is provided.

In the following sections, the needed steps to determine the spatial cue information 262 based on an analysis of the stereo microphone signals will be summarized. Here, reference will be made to the presentation in reference [2].

3. Stereo Signal Analysis

In the following, a stereo signal analysis will be described which may be performed by the spatial analyzer 120 or by the signal analyzer 220. It should be noted that in some embodiments, in which there are more than two microphones used and in which there are more than two channel signals of a multi-channel microphone signal, an enhanced signal analysis may be used.

The stereo signal analysis described herein may be used to provide the spatial cue parameters 122, which may take the form of the component energy information 122*a* and the direction information 122*b*. It should be noted that the stereo signal analysis may be performed in a time-frequency domain. Accordingly, the channel signals 210*a*, 210*b* of the multi-channel microphone signal 110, 210 may be transformed into a time-frequency domain representation for the purpose of the further analysis.

The time-frequency representation of the microphone signals $x_1(t)$ and $x_2(t)$ are $X_1(k, i)$ and $X_2(k, i)$, where k and i are time and frequency indices. It is assumed that $X_1(k, i)$ and $X_2(k, i)$ can be modeled as $$X_1(k,i)=S(k,i)+N_1(k,i)$$

$$X_2(k,i)=a(k,i)S(k,i)+N_2(k,i) \tag{1}$$

where a(k, i) is a gain factor, S(k, i) is the direct sound in the left channel, and $N_1(k, i)$ and $N_2(k, i)$ represent diffuse sound.

The spatial audio coding (SAC) downmix signal 112, 212 and side information 262 are computed as a function of a, $E\{SS^*\}$, $E\{N_1N_1^*\}$, and $E\{N_2N_2^*\}$, where $E\{.\}$ is a short-time averaging operation, and where * denotes complex conjugate. These values are derived in the following.

From (1) it follows that $$E\{X_1X_1^*\}=E\{SS^*\}+E\{N_1N_1^*\}$$

$$E\{X_2X_2^*\}=\alpha^2E\{SS^*\}+E\{N_2N_2^*\}$$

$$E\{X_1X_2^*\}=\alpha E\{SS^*\}+E\{N_1N_2^*\}. \tag{2}$$

It should be noted here that $E\{SS^*\}$ may be considered as a direct sound power information or, equivalently, a direct sound energy information, and that $E\{N_1N_1^*\}$ and $E\{N_2N_2^*\}$ may be considered as a diffuse sound power information or a diffuse sound energy information. $E\{SS^*\}$ and $E\{N_1N_1^*\}$ may be considered as a component energy information. a may be considered as a direction information.

It is assumed that the amount of diffuse sound in both microphone signals is the same, i.e., $E\{N_1N_1^*\}=E\{N_2N_2^*\}=E\{NN^*\}$ and that the normalized cross-correlation coefficient between $N_1$ and $N_2$ is $\phi_{diff}$, i.e., $$\Phi_{diff} = \frac{E\{N_1N_2^*\}}{\sqrt{E\{N_1N_1^*\}E\{N_2N_2^*\}}}. \tag{3}$$

$\phi_{diff}$ may, for example, take a predetermined value, or may be computed according to some algorithm.

Given these assumptions, (2) can be written as $$E\{X_1X_1^*\}=E\{SS^*\}+E\{NN^*\}$$

$$E\{X_2X_2^*\}=\alpha^2E\{SS^*\}+E\{NN^*\}$$

$$E\{X_1X_2^*\}=\alpha E\{SS^*\}+\phi_{diff}E\{NN^*\}. \tag{4}$$

Elimination of $E\{SS^*\}$ and a in (2) yields the quadratic equation $$AE\{NN^*\}+BE\{NN^*\}+C=0 \tag{5}$$

with $$A=1-\phi_{diff}^2,$$

$$B=2\phi_{diff}E\{X_1X_2^*\}-E\{X_1X_1^*\}-E\{X_2X_2\}^*,$$

$$C=E\{X_1X_1^*\}E\{X_2X_1^*\}-E\{X_1X_2^*\}^2. \tag{6}$$

Then $E\{NN^*\}$ is one of the two solutions of (5), the physically possible one, i.e., $$E\{NN^*\} = \frac{-B-\sqrt{B^2-4AC}}{2A}. \tag{7}$$

The other solution of (5) yields a diffuse sound power larger than the microphone signal power, which is physically impossible.

Given (7), it is easy to compute a and $E\{SS^*\}$:

$$a = \sqrt{\frac{E\{X_2X_2^*\}-E\{NN^*\}}{E\{X_1X_1^*\}-E\{NN^*\}}} \tag{8}$$

$$E\{SS^*\} = E\{X_1X_1^*\} - E\{NN^*\}$$

$$a^2E\{SS^*\} = E\{X_2X_2^*\} - E\{NN^*\}.$$

As discussed in reference [2], the direction-of-arrival a (k, i) of direct sound can be determined as a function of the estimated amplitude ratio a (k, i), $$\alpha(k,i)=f(\alpha(k,i)). \tag{9}$$

The specific mapping depends on the directional characteristics of the stereo microphones used for sound recording.

4. Generation of Spatial Side Information

In the following, the generation of the spatial cue information 262, which may be provided by the spatial side information generator 260, will be described. However, it should be noted that the generation of spatial side information in the form of the spatial cue information 262 is not a needed feature of embodiments of the present invention. Accordingly, it should be noted that the generation of the spatial side information can be omitted in some embodiments. Also, it should be noted that different methods for obtaining the spatial cue information 262, or any other spatial side information, may be used.

Nevertheless, it should also be noted that the generation of the spatial side information which is discussed in the following maybe considered as a concept for generating a spatial cue information.

Figure 4:
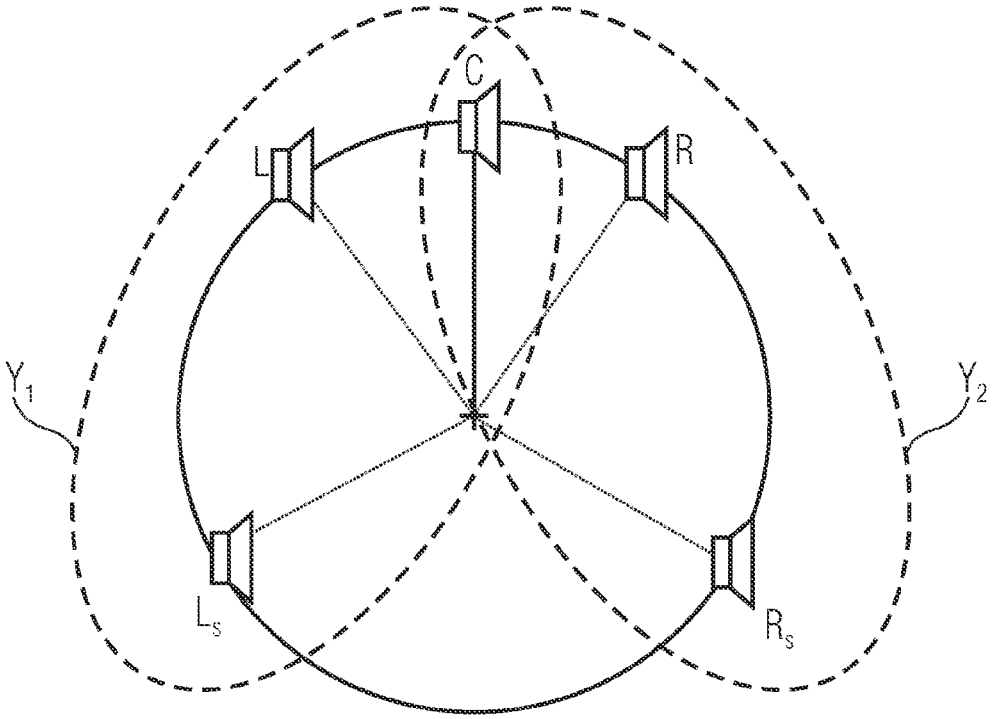
FIG. 4 shows a graphic illustration of the channel mapping for the computation of the desired downmix signals $Y_1$ and $Y_2$, which may be used in embodiments according to the invention.

Given the stereo signal analysis results 122*a*, 122*b*, i.e. the parameters a respectively a according to equation (9), $E\{SS^*\}$, and $E\{NN^*\}$, SAC decoder compatible spatial parameters are generated, for example, by the spatial side information generator 260. It has been found that one efficient way of doing this is to consider a multi-channel signal model. As an example, we consider the loudspeaker configuration as shown in FIG. 4 in the following, implying:

$$L(k,i)=g_1(k,i)\tilde{S}(k,i)+h_1(k,i)\tilde{N}_1(k,i)$$

$$R(k,i)=g_2(k,i)\tilde{S}(k,i)+h_2(k,i)\tilde{N}_2(k,i)$$

$$C(k,i)=g_3(k,i)\tilde{S}(k,i)+h_3(k,i)\tilde{N}_3(k,i)$$

$$L_s(k,i)=g_4(k,i)\tilde{S}(k,i)+h_4(k,i)\tilde{N}_4(k,i)$$

$$R_s(k,i)=g_5(k,i)\tilde{S}(k,i)+h_5(k,i)\tilde{N}_5(k,i), \tag{10}$$

where $\tilde{S}(k,i)$ is the direct sound signal and $\tilde{N}_1$ to $\tilde{N}_5$ are diffuse (inter-channel independent) signals. $\tilde{S}$ corresponds to the gain-compensated total amount of direct sound in the stereo microphone signal, i.e.

$$\tilde{S}(k,i) = 10^{\frac{g(\alpha)}{20}}\sqrt{1+a^2}\,S(k,i), \tag{11}$$

and the diffuse sound signals, $\tilde{N}_1$ to $\tilde{N}_5$, have all the same power equal to $E\{NN^*\}$. It should be noted that this diffuse sound power definition is arbitrary, since ultimately the gains $h_1$ to $h_5$ determine the amount of diffuse sound.

It should be noted that L(k,i), R(k,i), C(k,i), $L_s$(k,i) and $R_s$(k,i) may, for example, be desired channel signals or desired loudspeaker signals.

In a first step, as a function of direction of arrival of direct sound a(k, i), a multi-channel amplitude panning law (see, for example, references [7] and [4]) is applied to determine the gain factors $g_1$ to $g_5$. Then, a heuristic procedure is used to determine the diffuse sound gains $h_1$ to $h_5$. The constant values $h_1=1.0$, $h_2=1.0$, $h_3=0$, $h_4=1.0$, and $h_5=1.0$ are a reasonable choice, i.e. the ambience is equally distributed to front and rear, while the center channel is generated as a dry signal. However, a different choice of $h_1$ to $h_5$ is possible.

Direct sound from the side and rear is attenuated relative to sound arriving from forward directions. The direct sound contained in the microphone signals is advantageously gain compensated by a factor $g(\alpha)$ which depends on the directivity pattern of the microphones.

Given the surround signal model (10), the spatial cue analysis of the specific SAC used is applied to the signal model to obtain the spatial cues for MPEG Surround.

The power spectra of the signals defined in (10) are $$P_{LL_s}(k,i) = g_1 g_4 10^{\frac{g(\alpha)}{10}}(1+a^2)E\{SS^*\} \tag{14}$$

$$P_{RR_s}(k,i) = g_2 g_5 10^{\frac{g(\alpha)}{10}}(1+a^2)E\{SS^*\}.$$

The cross-spectra, used in the following are $$P_L(k,i) = g_1^2 E\{\tilde{S}\tilde{S}^*\} + h_1^2 E\{NN^*\} \tag{12}$$

$$P_R(k,i) = g_2^2 E\{\tilde{S}\tilde{S}^*\} + h_2^2 E\{NN^*\}$$

$$P_C(k,i) = g_3^2 E\{\tilde{S}\tilde{S}^*\} + h_3^2 E\{NN^*\}$$

$$P_{L_s}(k,i) = g_4^2 E\{\tilde{S}\tilde{S}^*\} + h_4^2 E\{NN^*\}$$

$$P_{R_s}(k,i) = g_5^2 E\{\tilde{S}\tilde{S}^*\} + h_5^2 E\{NN^*\},$$

where $$E\{\tilde{S}\tilde{S}^*\} = 10^{\frac{g(\alpha)}{10}}(1+a)^2 E\{SS^*\}. \tag{13}$$

MPEG surround applies a −3 dB gain ($g_s$ $1/\sqrt{2}$) to the surround channels prior to further processing them. This may be considered for generating compatible downmix and spatial side information.

The first two-to-one (TTO) box of MPEG Surround uses inter-channel level difference (ICLD) and inter-channel coherence (ICC) between L and $L_s$. Based on (10) and compensated for the pre-scaling of the surround channels these cues are $$ICLD_{LL_s} = 10\log_{10}\frac{P_L(k,i)}{g_s^2 P_{L_s}(k,i)} \tag{15}$$

$$ICC_{LL_s} = \frac{P_{LL_s}(k,i)}{\sqrt{P_L(k,i)P_{L_s}(k,i)}}.$$

Similarly, the ICLD and ICC of the second TTO box for R and $R_5$ are computed:

$$ICLD_{RR_s} = 10\log_{10}\frac{P_R(k,i)}{g_s^2 P_{R_s}(k,i)} \tag{16}$$

$$ICC_{RR_s} = \frac{P_{RR_s}(k,i)}{\sqrt{P_R(k,i)P_{R_s}(k,i)}}.$$

The three-to-two (TTT) box of MPEG Surround is used in "energy mode", see, for example, reference [1]. Note that the TTT box scales down the center channel by $\sqrt{1/2}$ before computing the downmixes and the spatial side information. Taking into account the pre-scaling of the surround channels, the two ICLD parameters used by the TTT box are $$ICLD_1 = 10\log_{10}\frac{P_L + g_s^2 P_{L_s} + P_R + g_s^2 P_{R_s}}{\frac{1}{2}P_C} \tag{17}$$

$$ICLD_2 = 10\log_{10}\frac{P_L + g_s^2 P_{L_s}}{P_R + g_s^2 P_{R_s}}.$$

Note that the indices i and k have been left away again for brevity of notation.

Accordingly, a spatial cue information comprising the cues $ICLD_{LLs}$, $ICC_{LLs}$, $ICLD_{RRs}$, $ICC_{RRs}$, $ICLD_1$ and $ICLD_2$ are obtained by the spatial side information generator 260 on the basis of the spatial cue parameters 122, 122*a*, 122*b*, i.e., on the basis of the component energy information 122*a* and the direction information 122*b*.

5. MPEG Surround Decoding

In the following, a possible MPEG Surround decoding will be described, which can be used to derive multiple channel signals like, for example, multiple loudspeaker signals, from a downmix signal (for example, from the enhanced downmix signal 112 or the enhanced downmix signal 212) using the spatial cue information 262 (or any other appropriate spatial cue information).

At the MPEG Surround decoder, the received downmix signal 112, 212 is expanded to more than two channels using the received spatial side information 262. This upmix is performed by appropriately cascading the so-called Reverse-One-To-Two (R-OTT) and the Reverse Three-To-Two (R-TTT) boxes, respectively (see, for example, reference [6]). While the R-OTT box outputs two audio channels based on a mono audio input and side information, the R-TTT box determines three audio channels based on a two-channel audio input and the associated side information. In other words, the reverse boxes perform the reverse processing as the corresponding TTT and OTT boxes described above.

Analogously to the multi-channel signal model at the encoder, the decoder assumes a specific loudspeaker configuration to correctly reproduce the original surround sound. Additionally, the decoder assumes that the MPS encoder (MPEG Surround encoder) performs a specific mixing of the multiple input channels to compute the correct downmix signal.

The computation of the MPEG Surround stereo downmix is presented in the next section.

6. Generation of the MPEG Surround Stereo Downmix Signal

In the following, it will be described how the MPEG Surround stereo downmix signal is generated.

In embodiments, the downmix is determined such that there is no crosstalk between loudspeaker channels conesponding to the left and right hemisphere. This has the advantage, that there is no undesired leakage of sound energy from left to the right hemisphere, which significantly increases the left/right separation after decoding the MPEG Surround stream. In addition, the same reasoning applies for signal leakage from right to left channels.

When MPEG surround is used for coding conventional 5.1 surround audio signals, the stereo downmix which is used is $$[Y_1 Y_2]^T = M[LRCL_sR_s]^T, \tag{18}$$

where the downmix matrix is $$M = \begin{bmatrix} 1 & 0 & \sqrt{\frac{1}{2}} & g_s & 0 \\ 0 & 1 & \sqrt{\frac{1}{2}} & 0 & g_s \end{bmatrix}, \tag{19}$$

where $g_s$ is the previously mentioned pre-gain given to the surround channel.

The downmix computation according to (18), (19) can be considered as a mapping of playback areas, covered by corresponding loudspeaker positions, to the two downmix channels. This mapping is illustrated in FIG. 4 for the specific case of the conventional downmix computation (18), (19).

7. Enhanced Downmix Computation

7.1 Overview over the Enhanced Downmix Computation

In the following, details regarding the enhanced downmix computation will be described. In order to facilitate the understanding of the advantages of the present concept, a comparison with some conventional systems will be given here.

In the case of the spatial audio microphone as described in Section 2, the downmix signal would basically correspond to the recorded signals of the stereo microphone (for example, of the microphone arrangement 205) in the absence of the enhanced downmix computation described in the following. It has been found that practical stereo microphones do not provide the desired separation of left and right signal components due to their specific directivity patterns. It has also been found that consequently, the cross talk between left and right channels (for example, channel signals 210*a* and 210*b*) is too high, resulting in a poor channel separation in the MPEG Surround decoded signal.

Embodiments according to the invention create an approach to compute an enhanced downmix signal 112, 212, which approximates the desired SAC downmix signals (for example, the signals $Y_1$, $Y_2$), i.e., it exhibits a desired level of crosstalk between the different channels, which is different from the crosstalk level included in the original stereo input 110, 210. This results in an improved sound quality after spatial audio decoding using the associated spatial side information 262.

The block schematics shown in FIGS. 1, 2, 3 and 5 illustrate the proposed approach. As can be seen, the original microphone signals 110, 210, 310 are processed by a downmix enhancement unit 140, 240, 340 to obtain enhanced downmix channels 112, 212, 312. The modification of the microphone signals 110, 210, 310 is controlled by a control unit 120, 130, 216, 316. The control unit takes into account the multi-channel signal model for the loudspeaker playback and the estimated spatial cue parameters 122, 122*a*, 122*b*, 322. From this information, the control unit determines a target for the enhancement, i.e, the model of the desired downmix signal (for example, downmix signals $Y_1$, $Y_2$). The details of the invention will be discussed in the following.

7.2 Model of the Desired Stereo Downmix Signal

In this section we discuss a model of the desired stereo downmix signal, which also present the target for the proposed enhanced downmix computation.

If we apply equations (18) and (19) to our assumed surround signal model according to equation (10), we get a model of the desired downmix signal according to $$\begin{aligned} Y_1 &= \left(g_1 + \frac{1}{\sqrt{2}} g_3 + g_s g_4\right)\tilde{S} + \overline{N}_1 \\ Y_2 &= \left(g_2 + \frac{1}{\sqrt{2}} g_3 + g_s g_5\right)\tilde{S} + \overline{N}_2, \end{aligned} \tag{20}$$

where the two diffuse sound signals $\overline{N}_1$ and $\overline{N}_2$ are $$\begin{aligned} \overline{N}_1 &= h_1\tilde{N}_1 + \frac{1}{\sqrt{2}}\tilde{N}_3 + g_s h_4 \tilde{N}_4 \\ \overline{N}_2 &= h_2\tilde{N}_2 + \frac{1}{\sqrt{2}}\tilde{N}_3 + g_s h_5 \tilde{N}_5. \end{aligned} \tag{21}$$

The diffuse sound in the left and right microphone signal is $N_1$ and $N_2$. Thus, the downmix should be based on diffuse sound related to $N_1$ and $N_2$. Since, as defined previously, the power of $N_1$, $N_2$, and $\tilde{N}1$ to $\tilde{N}5$ are the same, diffuse signals based on $N_1$ and $N_2$ with the same power as $\overline{N}1$ and $\overline{N}2$ (21) are $$\begin{aligned} \overline{N}_1 &= \sqrt{h_1^2 + \frac{1}{2}h_3^2 + g_s^2 h_4^2}\, N_1 \\ \overline{N}_2 &= \sqrt{h_2^2 + \frac{1}{2}h_3^2 + g_s^2 h_5^2}\, N_2. \end{aligned} \tag{22}$$

Accordingly, the model of the desired stereo downmix signal allows to express the channel signals $Y_1$, $Y_2$ of the desired stereo downmix signal as a function of the gain values $g_1$, $g_2$, $g_3$, $g_4$, $g_s$, $g_s$, $h_1$, $h_2$, $h_3$, $h_4$, $h_5$ and also in dependence on the gain-compensated total amount $\tilde{S}$ of direct sound in the stereo microphone signal and the diffuse signal $N_1$, $N_2$.

7.3 Single Channel Filtering

In the following, an approach will be described in which a first channel of the enhanced downmix signal is derived from a first channel signal of the multi-channel microphone signal and in which a second channel of the enhanced downmix signal is derived from a second channel signal of the multi-channel microphone signal. It should be noted that the filtering described in the following can be performed by the filter 140 or by the two-channel audio signal provider 240 or by the downmix enhancement 340. It should also be noted that the enhancement filter parameters $H_1$, $H_2$ may be provided by the filter calculator 130, by the filter calculator 230 or by the control 316.

One possible approach to determine the desired downmix signals $Y_1(k, i)$ and $Y_2(k, i)$ according to (20), is to apply an enhancement filter to the original stereo microphone input $X_1(k, i)$ and $X_2(k, i)$, i.e., $$\hat{Y}_1(k,i)=H_1(k,i)X_1(k,i)$$

$$\hat{Y}_2(k,i)=H_2(k,i)X_2(k,i), \tag{23}$$

These filters are chosen such that $\hat{Y}_1(k, i)$ and $\hat{Y}_2(k, i)$ (i.e, the actual downmix signals obtained by filtering the channel signals of the multi-channel microphone signal) approximate the desired downmix signals $Y_1(k, i)$ and $Y_2(k, i)$, respectively. A suitable approximation is that $\hat{Y}_1(k, i)$ and $\hat{Y}_2(k, i)$ share the same energy distribution with respect to the energies of the multi-channel loudspeaker signal model as it is given in the target downmix signals $Y_1(k, i)$ and $Y_2(k, i)$, respectively. In other words, the filters are chosen such that the actual downmix signals obtained by filtering the channel signals of the multi-channel microphone signal approximate the desired downmix signals with respect to some statistical properties like, for example, energy characteristics or cross-correlation characteristics.

In case that the enhancement filters correspond to Wiener filters (see, for example, reference [5]), $H_1(k, i)$ and $H_2(k, i)$ can be determined according to $$H_1 = \frac{E\{X_1 Y_1^*\}}{E\{X_1 X_1^*\}} \tag{24}$$

$$H_2 = \frac{E\{X_2 Y_2^*\}}{E\{X_2 X_2^*\}}.$$

Substituting (20) with (22) into (24), yields $$H_1 = \frac{w_1 E\{SS^*\} + w_3 E\{NN^*\}}{E\{SS^*\} + E\{NN^*\}} \tag{25}$$

$$H_2 = \frac{w_2 E\{SS^*\} + \omega_4\{NN^*\}}{a^2 E\{SS^*\} + E\{NN^*\}},$$

with $$w_1 = 10^{\frac{g(\alpha)}{20}} \sqrt{1+a^2}\left(g_1 + \frac{1}{\sqrt{2}} g_3 + g_s g_4\right) \tag{26}$$

$$w_2 = 10^{\frac{g(\alpha)}{20}} a\sqrt{1+a^2}\left(g_2 + \frac{1}{\sqrt{2}} g_3 + g_s g_5\right) \tag{27}$$

$$w_3 = \sqrt{h_1^2 + \frac{1}{2} h_3^2 + g_s^2 h_4^2} \tag{28}$$

$$w_4 = \sqrt{h_2^2 + \frac{1}{2} h_3^2 + g_s^2 h_5^2}. \tag{29}$$

Figure 3:
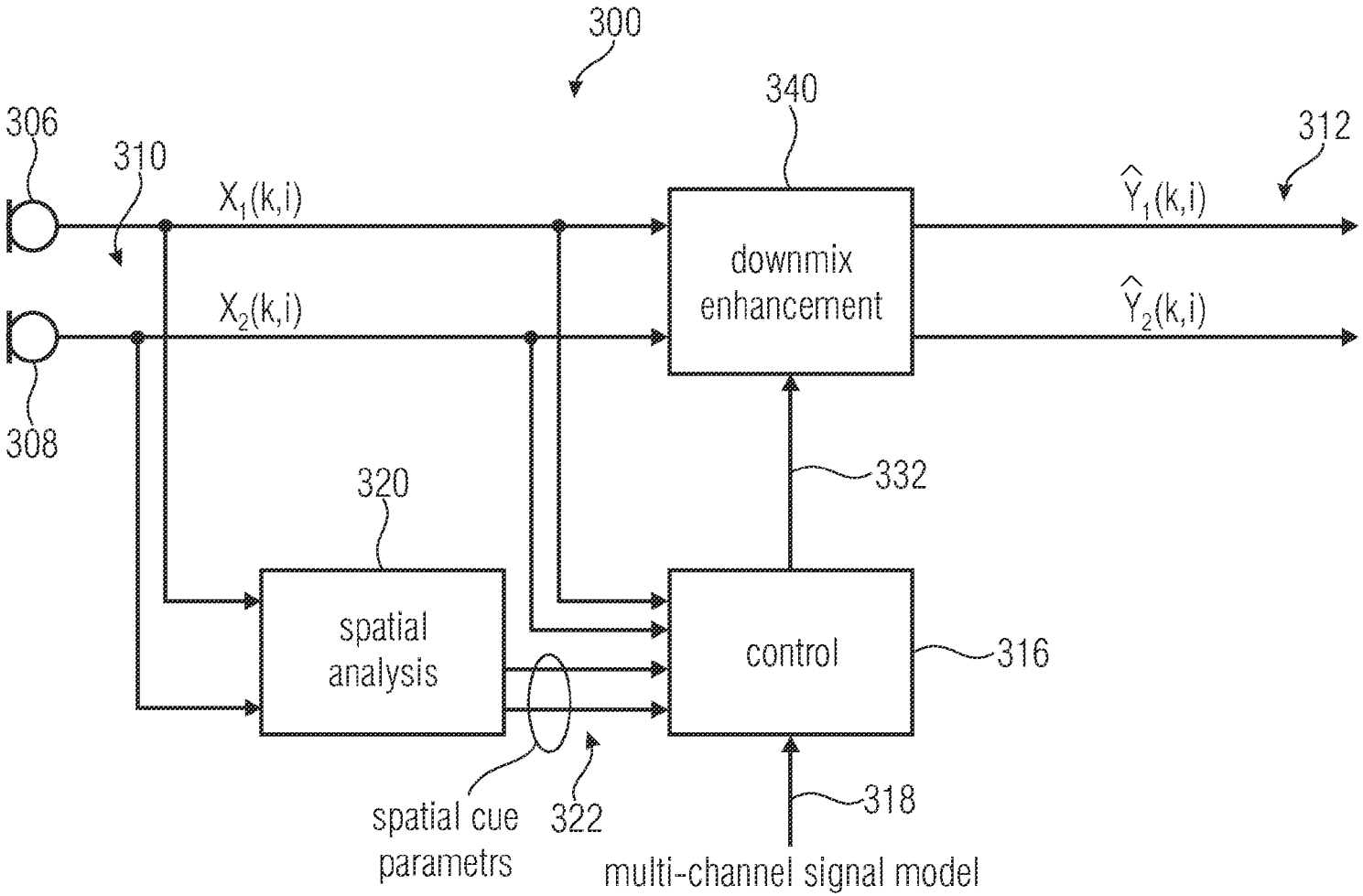
FIG. 3 shows a graphic illustration of the enhanced downmix computation, according to an embodiment of the invention.

As can be noticed, the enhancement filters directly depend on the different components of the multi-channel signal model (10). Since these components are estimated based on the spatial cue parameters, we can conclude that the filters $H_1(k, i)$ and $H_2(k, i)$ for the enhanced downmix computation depend on these spatial cue parameters, too. In other words, the computation of the enhancement filters can be controlled by the estimated spatial cue parameters, as also illustrated in FIG. 3.

7.4 Two-Channel Filtering

In this section we present an alternative method to the single-channel approach discussed in the section titled "single channel filtering". In this case, each enhanced downmix channel $\hat{Y}_1$, $\hat{Y}_2$ is determined from filtered versions of both microphone input signals $X_1$, $X_2$. As this approach is able to combine both microphone channels in an optimum way, improved performance compared to the single-channel filtering method can be expected.

The actual downmix signal can be obtained according to $$\hat{Y}_1(k, i) = [\, H_{1,1} \quad H_{1,2} \,] \begin{bmatrix} X_1(k, i) \\ X_2(k, i) \end{bmatrix} \tag{30}$$

$$\hat{Y}_2(k, i) = [\, H_{2,1} \quad H_{2,2} \,] \begin{bmatrix} X_1(k, i) \\ X_2(k, i) \end{bmatrix} \tag{31}$$

In the following we show the example of estimating the enhancement filters based on two-channel Wiener filters. For presentational simplicity, we drop the indices (k, i) in the following. The Wiener-Hopf equation for the first downmix channel $\hat{Y}_1(k, i)$ is:

$$\begin{bmatrix} E\{X_1 X_1^*\} & E\{X_1 X_2^*\} \\ E\{X_2 X_1^*\} & E\{X_2 X_2^*\} \end{bmatrix} \begin{bmatrix} H_{1,1} \\ H_{1,2} \end{bmatrix} = \begin{bmatrix} E\{X_1 Y_1^*\} \\ E\{X_2 Y_1^*\} \end{bmatrix} \tag{32}$$

The filters are therefore obtained as $$\begin{bmatrix} H_{1,1} \\ H_{1,2} \end{bmatrix} = \frac{1}{d} \begin{bmatrix} E\{X_2 X_2^*\} & -E\{X_1 X_2^*\} \\ -E\{X_2 X_1^*\} & E\{X_1 X_1^*\} \end{bmatrix} \begin{bmatrix} E\{X_1 Y_1^*\} \\ E\{X_2 Y_1^*\} \end{bmatrix} \tag{33}$$

$$\begin{bmatrix} H_{2,1} \\ H_{2,2} \end{bmatrix} = \frac{1}{d} \begin{bmatrix} E\{X_2 X_2^*\} & -E\{X_1 X_2^*\} \\ -E\{X_2 X_1^*\} & E\{X_1 X_1^*\} \end{bmatrix} \begin{bmatrix} E\{X_1 Y_2^*\} \\ E\{X_2 Y_2^*\} \end{bmatrix}$$

where $$d = E\{X_1 X_1^*\} E\{X_2 X_2^*\} - E\{X_1 X_2^*\} E\{X_2 X_1^*\}. \tag{34}$$

The cross-correlation between the microphone input signals $X_1$, $X_2$ and the desired downmix channels $Y_1$, $Y_2$ can be expressed by $$E\{X_1 Y_1^*\} = w_1 E\{SS^*\} + w_3 E\{NN^*\} \tag{35}$$

$$E\{X_2 Y_1^*\} = a w_1 E\{SS^*\} + w_3 \Phi_{diff} E\{NN^*\}$$

$$E\{X_1 Y_2^*\} = \frac{w_2}{a} E\{SS^*\} + w_4 \Phi_{diff} E\{NN^*\}$$

$$E\{X_2 Y_2^*\} = w_2 E\{SS^*\} + w_4 E\{NN^*\}$$

where the weights $w_i$ have been introduced in (26)-(29).

7.5 Selection Between One-Channel Filtering and Two-Channel Filtering

In the following, a concept will be described which allows for a signal-adaptive selection between a one-channel filtering and a two-channel filtering.

The two-channel filtering, as described so far, has the problem that in practice it sometimes (or even often) yields filters which introduce audio artifacts. Whenever the left and right channel are highly correlated, the covariance matrix in the Wiener-Hopf equation is badly conditioned. The resulting numerical sensitivity results then in filters which are unreasonable and cause audio artifacts. To prevent this, the single-channel filtering is used, whenever the two channels exceed a certain degree of correlation. This can be implemented by computing the filters as $$H_{1,1} = H_1 \quad (36)$$
$$H_{1,2} = 0$$
$$H_{2,1} = 0$$
$$H_{2,2} = H_2,$$

whenever $$\frac{|E\{X_1 X_2^*\}|}{\sqrt{E\{X_1 X_1^*\}E\{X_2 X_2^*\}}} > T, \quad (37)$$

where the coherence/correlation threshold T determines at which degree of correlation the single-channel filtering is used. A value of T=0.9 yields good results.

In other words, it is possible to selectively switch between a one-channel filtering and a two-channel filtering in dependence on a degree of correlation between any channel signals of the multi-channel microphone signal. If the correlation is larger than a predetermined correlation value, a one-channel filtering may be used instead of a two-channel filtering.

7.6 General Multi-Channel Case

In the following we will generalize the enhanced computation of MPEG Surround stereo downmix signals based on a multi-channel signal model according to (10), to more general channel configurations. Analogously to (10), the generalized multi-channel signal model assuming K loudspeaker channels is given by $$Z_1(k,i)=g_2(k,i)\tilde{S}(k,i)+h_2(k,i)\tilde{N}_1(k,i), \quad (38)$$

with l=1, 2 . . . , K. The gain factors $g_1(k, i)$ depend on the DOA of direct sound and the position of the lth loudspeaker within the playback configuration. The gain factors $h_1$ may be predetermined and used, as explained above. $Z_1$ represent desired channel signals of a plurality of channels with l=1, 2, . . . K.

The computation of the signal $Y_j(k, i)$ of a desired downmix channel j is obtained by an appropriate mixing operation according to $$Y_j(k, i) = \sum_{l=0}^{K-1} m_{j,l} Z_l(k, i). \quad (39)$$

The mixing weights $m_{j,1}$ represent a specific spatial partitioning or mapping of playback areas, which are associated with the position of the lth loudspeaker, to the jth downmix channel.

To give an example: In case that a loudspeaker channel 1, i.e., a certain reproduction area, should not contribute to the jth downmix signal, the corresponding mixing weight $m_{j,1}$ is set to zero.

Analogously to (23), (30), and (30), respectively, the original microphone input channels $X_j(k, i)$ are modified by appropriately chosen enhancement filters to approximate the desired downmix channels $Y_j$ (k, i).

In case of a single-channel filter, we have $$\hat{Y}_j(k,i)=H_1(k,i)X_j(k,i). \quad (40)$$

Here, $\hat{Y}_J$ designates actual channel signals of the multi-channel downmix signal.

Note, that (40) can also be applied in case that there are more than two input microphone signals available. The resulting filters also depend on the estimated spatial cue parameters. Here, however, we do not discuss the estimation of the spatial cue parameters based on more than two microphone input channels, as this is not an essential part of the invention.

It is possible to derive the needed equations for the general multi-channel downmix enhancement filters analogously to (30), (30). Assuming M microphone input signals, the jth desired downmix channel $Y_j(k, i)$ is approximated by applying M enhancement filters to the corresponding microphone signals $X_m(k, i)$:

$$\hat{Y}_1(k,i)=H_j^T(k,i)X(k,i), \quad (41)$$

$$X(k,i)=[X_1(k,i),X_2(k,i), \ldots ,X_M(k,i)]^T, \quad (42)$$

$$H_j(k,i)=[H_{j,1}(k,i),H_{j,2}(k,i), \ldots ,H_{j,M}(k,i)]^T. \quad (43)$$

The corresponding desired downmix channel $Y_j(k, i)$ can be obtained from (39) using the generalized signal model (38).

The elements of the multi-channel enhancement matrix $H_j(k, i)$ can be obtained by solving the corresponding Wiener-Hopf equation $$E\{X(k,i)X^H(k,i)\}H_j(k,i)=E\{X(k,i)Y^*(k,i)\}. \quad (44)$$

where $^H$ denotes the hermitian of an operand.

In should be mentioned, that the method described above can be considered as a general microphone crosstalk suppressor based on spatial cue information if the number of loudspeakers K in the multi-channel signal model (38) is chosen large. In this case, the loudspeaker position can directly be considered as a corresponding DOA of direct sound. Applying the invention, a flexible crosstalk suppressor can be implemented using one or more suppression filters.

8. Pre-Processing of the Microphone Signals

Figure 5:
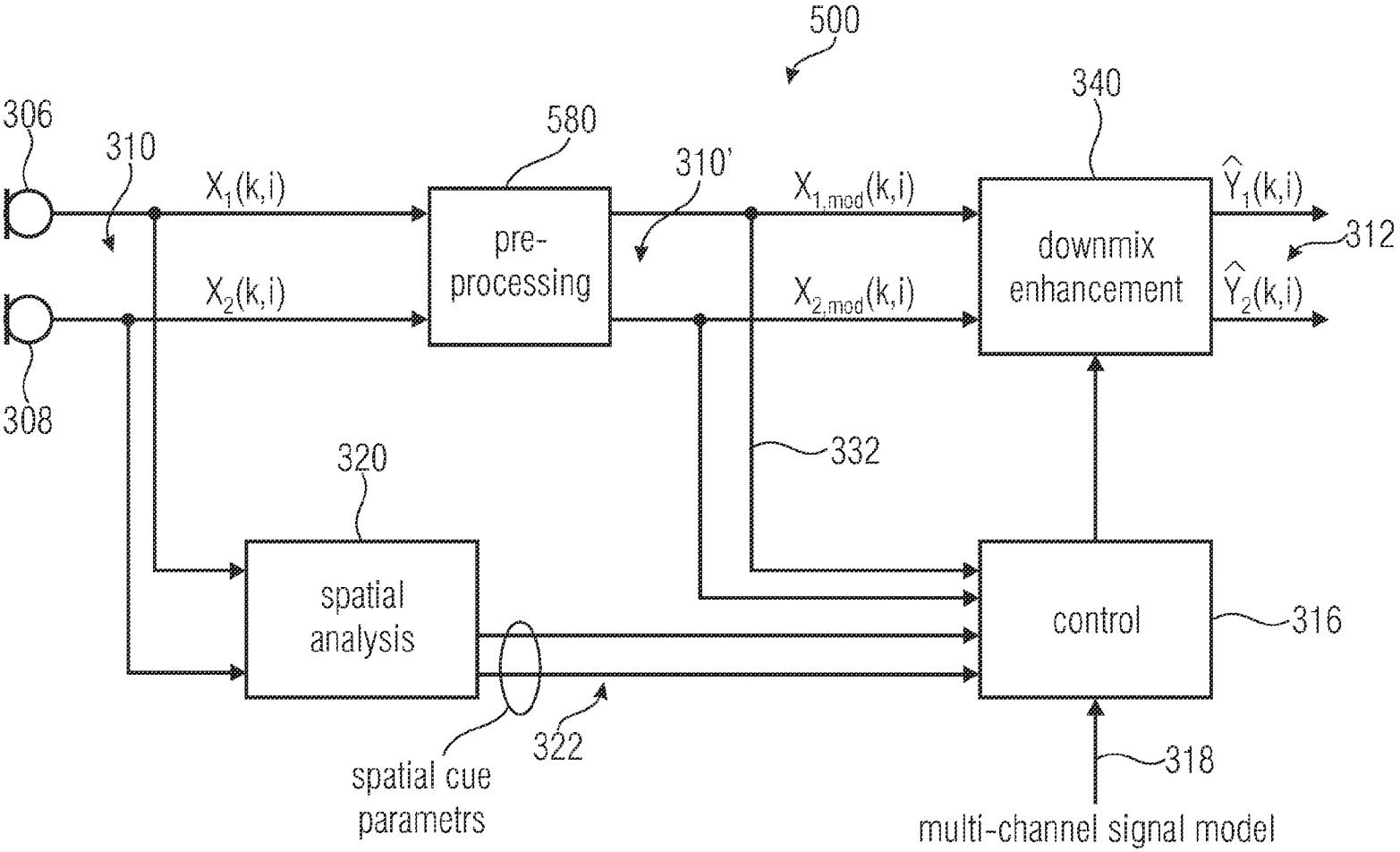
FIG. 5 shows a graphic illustration of an enhanced downmix computation based on preprocessed microphone signals, according to an embodiment of the invention.

So far, we only considered the case, where the signals $X_j(k, i)$ represent the output signals of microphones. The proposed new concept or method can, alternatively, also be applied to pre-processed microphone signals instead. The corresponding approach is illustrated in FIG. 5.

The pre-processing can be implemented by applying fixed time-invariant beamforming (see, for example, reference [8]) based on the original microphone input signals. As a result of the pre-processing, some part of the undesired signal leakage to certain microphone signals can already be mitigated, before applying the enhancement filters.

The enhancement filters based on pre-processed input channels can be derived analogously to the filters discussed above, by replacing $X_j(k, i)$ by the output signals of the pre-processing stage $X_{j,mod}(k, i)$.

9. Apparatus According to FIG. 3

FIG. 3 shows a block schematic diagram of an apparatus 300 for generating an enhanced downmix signal on the basis of a multi-channel microphone signal, according to another embodiment of the invention.

The apparatus 300 comprises two microphones 306, 308, which provide a two-channel microphone signal 310, comprising a first channel signal, which is represented by a time-frequency-domain representation $X_1$ (k, i), and a second channel signal which is represented by a second time-frequency representation $X_2$ (k, i). Apparatus 300 also comprises a spatial analysis 320, which receives the two-channel microphone signal 310 and provides, on the basis thereof, spatial cue parameters 322. The spatial analysis 320 may take the functionality of the spatial analyzer 120 or of the signal analyzer 220, such that the spatial cue parameters 322 may be equivalent to the spatial cue parameters 122 or to the compound energy information 122*a* and the direction information 122*b*. The apparatus 300 also comprises a control device 316, which receives the spatial cue parameters 322 and which also receives the two-channel microphone signal 310. The control unit 316 also receives a multi-channel signal model 318 or comprises parameters of such a multi-channel signal model 318. Control device 316 provides enhancement filter parameters 332 to the downmix enhancement device 340. The control device 316 may, for example, take the functionality of the filter calculator 130 or of the filter calculator 230, such that the enhancement filter parameters 332 may be equivalent to the enhancement filter parameters 132 or the enhancement filter parameters 232. The downmix enhancement device 340 receives the two-channel microphone signal 310 and also the enhancement filter parameters 332 and provides, on the basis thereof, the (actual) enhanced multi-channel downmix signal 312. A first channel signal of the enhanced multi-channel downmix signal 312 is represented by a time frequency representation $\hat{Y}_1$(k, i) and a second channel signal of the enhanced multi-channel downmix signal 312 is represented by a time frequency representation $\hat{Y}_2$(k, i). It should be noted that the downmix enhancement device 340 may take the functionality of the filter 140 or of the two-channel audio signal provider 240.

10. Apparatus According to FIG. 5

FIG. 5 shows a block schematic diagram of an apparatus 500 for generating an enhanced downmix signal on the basis of a multi-channel microphone signal. The apparatus 500 according to FIG. 5 is very similar to the apparatus 300 according to FIG. 3 such that identical means and signals are designated with equal reference numerals and will not be explained again. However, in addition to the functional blocks of the apparatus 300, the apparatus 500 also comprises a preprocessing 580, which receives the multi-channel microphone signal 310 and provides, on the basis thereof, a preprocessed version 310' of the multi-channel microphone signal. In this case, the downmix enhancement 340 receives the processed version 310' of the multi-channel microphone signal 210, rather than the multi-channel microphone signal 310 itself. Also, the control device 316 receives the processed version 310' of the multi-channel microphone signal, rather than the multi-channel microphone signal 310 itself. However, the functionality of the downmix enhancement 340 and of the control device 316 is not substantially affected by this modification.

11. Allocation of Channel Signals to Downmix Signals According to FIG. 4

As discussed above, the modeling of the downmix, which is used to derive the desired downmix channels $Y_1$, $Y_2$ or some of the statistical characteristics thereof comprises a mapping of a direct sound component (for example, $\tilde{S}$(k, i)) and of diffuse sound components (for example, $\tilde{N}_1$ (k, i)) onto channel signals (for example, L (k, i), R (k, i), C (k, i), L, (k, i), R, (k, i) or $Z_1$ (k, i)) and a mapping of loudspeaker channel signals onto downmix channel signals.

Regarding the first mapping of the direct sound component and the diffuse sound component onto the loudspeaker channel signals, a direction dependent mapping can be used, which is described by the gain factors $g_1$. However, regarding the mapping of the loudspeaker channel signals onto the downmix channel signals, fixed assumptions may be used, which may be described by a downmix matrix. As illustrated in FIG. 4, it may be assumed that only the loudspeaker channel signals C, L and L, should contribute to the first downmix channel signal $Y_1$, and that only the loudspeaker channel signals C, R and $R_s$ should contribute to the downmix channel signal $Y_2$.

This is illustrated in FIG. 4.

12. Signal Processing Flow According to FIG. 6

Figure 6:
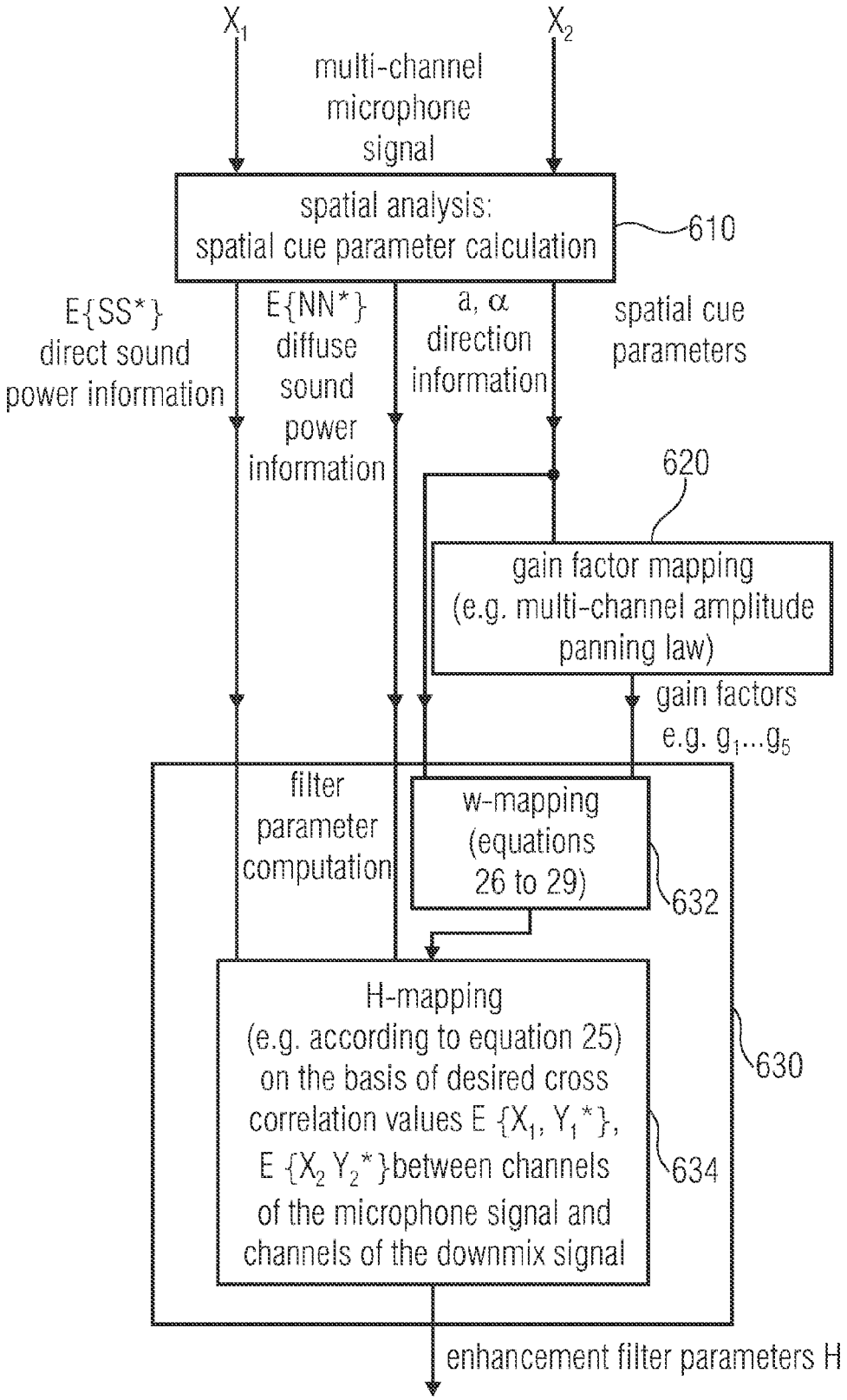
FIG. 6 shows a schematic representation of computations for deriving the enhancement filter parameters from the multi-channel microphone signal, according to an embodiment of the invention.

In the following, the flow of the signal processing in an embodiment according to the invention will be described taking reference to FIG. 6. FIG. 6 shows a schematic representation of the signal processing flow for deriving the enhancement filter parameters H from the multi-channel microphone signal represented, for example, by time frequency representations $X_1$ and $X_2$.

The processing flow 600 comprises, for example, as a first step, a spatial analysis 610, which may take the functionality of a spatial cue parameter calculation. Accordingly, a direct sound power information (or direct sound energy information) E {SS*}, a diffuse sound power information (or diffuse sound energy information) E {NN*} and a direction information α, a may be obtained on the basis of the multi-channel microphone signals. Details regarding the derivation of the direct sound power information (or direct sound energy information) of the diffuse sound power information (or diffuse sound energy information) and the direction information have been discussed above.

The processing flow 600 also comprises a gain factor mapping 620, in which the direction information is mapped on a plurality of gain factors (for example, gain factors $g_1$ to $g_5$). The gain factor mapping 620 may, for example, be performed using a multi-channel amplitude panning law, as described above.

The processing flow 600 also comprises a filter parameter computation 630, in which the enhancement filter parameters H are derived from the direct sound power information, the diffuse sound power information, the direction information and the gain factors. The filter parameter computation 630 may additionally use one or more constant parameters describing, for example, a desired mapping of loudspeaker channels onto downmix channel signals. Also, predetermined parameters describing a mapping of the diffuse sound component onto the loudspeaker signals may be applied.

The filter parameter computation comprises, for example, a w-mapping 632. In the w-mapping, which may be performed in accordance with equations 26 to 29, values $w_1$ to $w_4$ may be obtained which may serve as intermediate quantities. The filter parameter computation 630 further comprises a H-mapping 634, which may, for example, be performed according to equation 25. In the H-mapping 634, the enhancement filter parameters H may be determined. For the H-mapping, desired cross correlation values E $\{X_1, Y_1^*\}$, E$\{X_2Y_2^*\}$ between channels of the microphone signal and the channels of the downmix signal may be used. These desired cross correlation values may be obtained on the basis of the direct sound power information E {SS*} and E {NN*}, as can be seen in the numerator of the equations (25), which is identical to a numerator of equations (24).

To conclude, the processing flow of FIG. 6 can be applied to derive the enhancement filter parameters H from the multi-channel microphone signal represented by the channel signals $X_1$, $X_2$.

13. Signal Processing Flow According to FIG. 7

Figure 7:
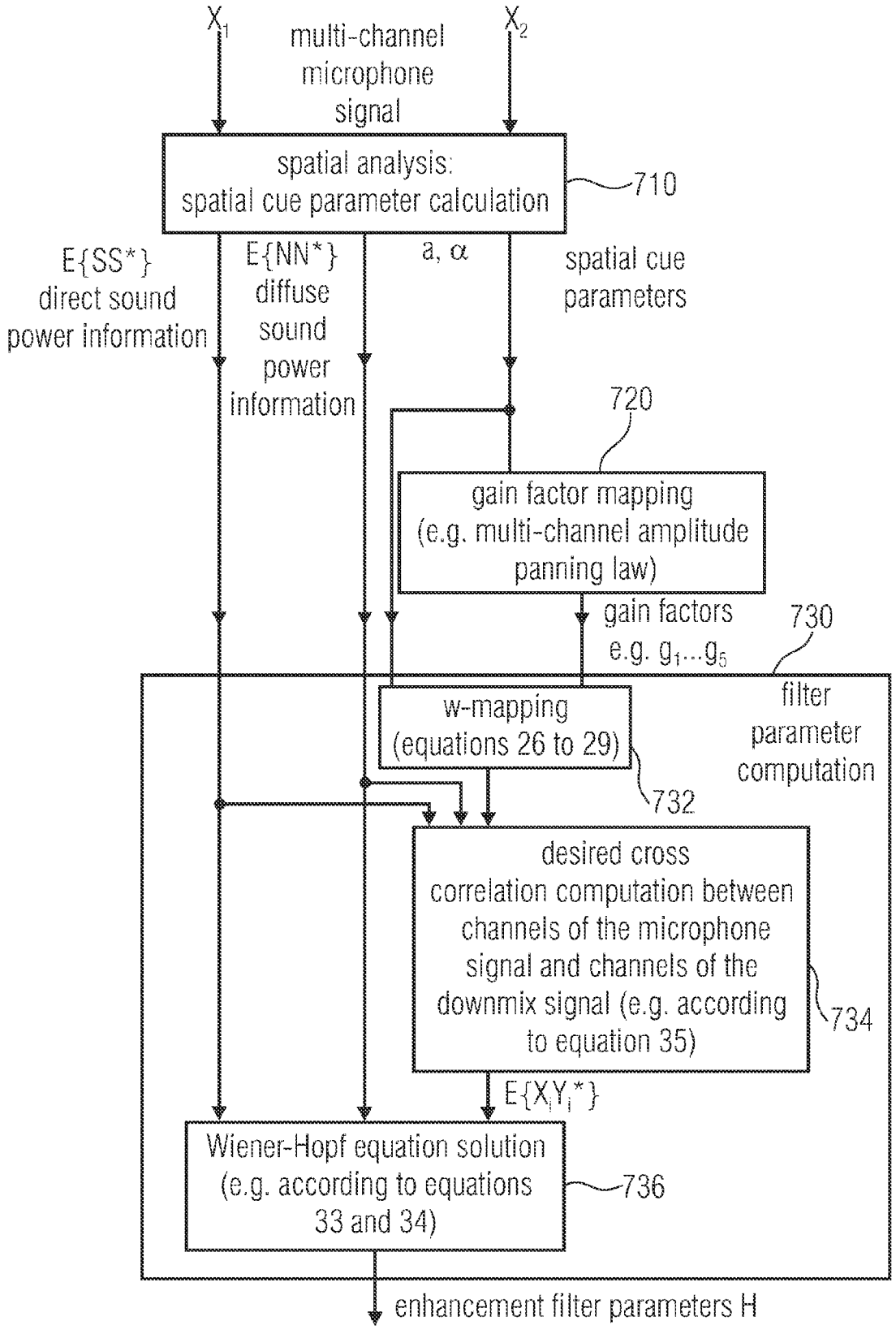
FIG. 7 shows a schematic representation of computations for deriving the enhancement filter parameters from the multi-channel microphone signal, according to another embodiment of the invention.

FIG. 7 shows a schematic representation of a signal processing flow 700, according to another embodiment of the invention. The signal processing flow 700 can be used to derive enhancement filter parameters H from a multi-channel microphone signal.

The signal processing flow 700 comprises a spatial analysis 710, which may be identical to the spatial analysis 610. Also, the signal processing flow 700 comprises a gain factor mapping 720, which may be identical to the gain factor mapping 620.

The signal processing flow 700 also comprises a filter parameter computation 730. The filter parameter computation 730 may comprise a w-mapping 732, which may be identical to the w-mapping 632 in some cases. However, different w-mapping may be used, if this appears to be appropriate.

The filter parameter computation 730 also comprises a desired cross correlation computation 734, in the course of which a desired cross correlation between channels of the multi-channel microphone signal and channels of the (desired) downmix signal are computed. This computation may, for example, be performed in accordance with equation 35. It should be noted that a model of a desired downmix signal may be applied in the desired cross correlation computation 734. For example, assumptions on how the direct sound component of the multi-channel microphone signal should be mapped to a plurality of loudspeaker signals in dependence on the direction information may be applied in the desired cross correlation computation 734. In addition, assumptions of how diffuse sound components of the multi-channel microphone signal should be reflected in the loudspeaker signals may also be evaluated in the desired cross correlation computation 734. Moreover, assumptions regarding a desired mapping of multiple loudspeaker channels onto the downmix signal may also be applied in the desired cross correlation computation 734. Accordingly, a desired cross correlation $E\{X_i Y_j^*\}$ between channels of the microphone signal and channels of the (desired) downmix signal may be obtained on the basis of the direct sound power information, the diffuse sound power information, the direction information and direction-dependent gain factors (wherein the latter information may be combined to obtain intermediate values w).

The filter parameter computation 730 also comprises the solution of a Wiener-Hopf equation 736, which may, for example, be performed in accordance with equations 33 and 34. For this purpose, the Wiener-Hopf equation may be set up in dependence on the direct sound power information, the diffuse sound power information and the desired cross correlation between channels of the multi-channel microphone signal and channels of the (desired) downmix signal. As a solution of the Wiener-Hopf equation (for example, the equation 32) enhancement filter parameters H are obtained.

To summarize the above, the determination of enhancement filter parameters H may comprise separate steps of computing a desired cross correlation and of setting-up and solving a Wiener-Hopf equation (step 736) in some embodiments.

14. Conclusions

To summarize the above, embodiments according to the invention create an enhanced concept and method to compute a desired downmix signal of parametric spatial audio coders based on microphone input signals. An important example is given by the conversion of a stereo microphone signal into an MPEG Surround downmix corresponding to the computed MPS parameters. The enhanced downmix signal leads to a significantly improved spatial audio quality and localization property after MPS decoding, compared to the state-of-the-art case proposed in reference [2]. A simple embodiment according to the invention comprises the following steps 1 to 4:

1. receiving microphone input signals;
2. computing spatial cue parameters;
3. determining downmix enhancement filters based on a model of the desired downmix channels, a multi-channel loudspeaker signal model for the decoder output, and spatial cue parameters; and
4. applying the enhancement filters to the microphone input signals to obtain enhanced downmix signals for use with spatial audio microphones.

Another simple embodiment according to the invention creates an apparatus, a method or a computer program for generating a downmix signal, the apparatus method or computer program comprising a filter calculator for calculating enhancement filter parameters based on information on a microphone signal or based on information on an intended replay setup, and the apparatus method or computer program comprising a filter arrangement (or filtering step) for filtering microphone signals using the enhancement filter parameters to obtain the enhanced downmix signal.

This apparatus, method or computer program can optionally be improved in that the filter calculator is configured for calculating the enhancement filter parameters based on a model of the desired downmix channels, a multi-channel loudspeaker signal model for the decoder output or spatial cue parameters.

15. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver my, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] ISO/IEC 23003-1:2007. Information technology—MPEG Audio technologies—Part 1: MPEG Surround. International Standards Organization, Geneva, Switzerland, 2007.

[2] C. Faller. Microphone front-ends for spatial audio coders. In 125th AES Convention, Paper 7508, San Francisco, October 2008.

[3] M. A. Gerzon. Periphony: Width-Height Sound Reproduction. J. Aud. Eng. Soc., 21(1):2-10, 1973.

[4] D. Griesinger. Stereo and surround panning in practice. In Preprint 112th Cony. Aud. Eng. Soc., May 2002.

[5] S. Haykin. Adaptive Filter Theory (third edition). Prentice Hall, 1996.

[6] J. Herne, K. Kj"orling, J. Breebaart, C. Faller, S. Disch, H. Purnhagen, J. Koppens, J. Hilpert, J. R"od'en, W. Oomen, K. Linzmeier, and K. S. Chong. Mpeg surround—the iso/mpeg standard for efficient and compatible multi-channel audio coding. In Preprint 122th Cony. Aud. Eng. Soc., May 2007.

[7] V. Pulkki. Virtual sound source positioning using Vector Base Amplitude Panning J Audio Eng. Soc., 45:456-466, June 1997.

[8] B. D. Van Veen and K. M. Buckley. Beamforming: A versatile approach to spatial filtering. IEEE ASSP Magazine, 5(2):4-24, April 1988.

The invention claimed is:

1. An apparatus for generating an enhanced downmix signal on the basis of a multi-channel microphone signal, the apparatus comprising:

a spatial analyzer configured to compute a set of spatial cue parameters comprising a direction information describing a direction-of-arrival of direct sound, a direct sound power information and a diffuse sound power information, on the basis of the multi-channel microphone signal;

a filter calculator for calculating enhancement filter parameters in dependence on the direction information describing the direction-of-arrival of the direct sound, in dependence on the direct sound power information and in dependence on the diffuse sound power information; and a filter for filtering the microphone signal, or a signal derived therefrom, using the enhancement filter parameters, to acquire the enhanced downmix signal;

wherein the filter calculator is configured to calculate the enhancement filter parameters in dependence on direction-dependent gain factors which describe desired contributions of a direct sound component of the multi-channel microphone signal to a plurality of loudspeaker signals and in dependence on one or more downmix matrix values which describe desired contributions of a plurality of audio channels to one or more channels of the enhanced downmix signal.

2. The apparatus according to claim 1, wherein the filter calculator is configured to calculate the enhancement filter parameters such that the enhanced downmix signal approximates a desired downmix signal.

3. The apparatus according to claim 1, wherein the filter calculator is configured to calculate desired cross-correlation values between channel signals of the multi-channel microphone signal and desired channel signals of the downmix signal in dependence on the spatial cue parameters, and wherein the filter calculator is configured to calculate the enhancement filter parameters in dependence on the desired cross-correlation values.

4. The apparatus according to claim 3, wherein the filter calculator is configured to calculate the desired cross-correlation values in dependence on direction-dependent gain factors which describe desired contributions of a direct sound component of the multi-channel microphone signal to a plurality of loudspeaker signals.

5. The apparatus according to claim 4, wherein the filter calculator is configured to map the direction information onto a set of direction-dependent gain factors.

6. The apparatus according to claim 3, wherein the filter calculator is configured to consider the direct sound power information and the diffuse sound power information to calculate the desired cross-correlation values.

7. The apparatus according to claim 6, wherein the filter calculator is configured to weight the direct sound power information in dependence on the direction information, and to apply a predetermined weighting, which is independent from the direction information, to the diffuse sound power information in order to calculate the desired cross-correlation values.

8. The apparatus according to claim 1, wherein the filter calculator is configured to compute filter coefficients $H_1$, $H_2$ according to $$H_1 = \frac{w_1 E\{SS^*\} + w_3 E\{NN^*\}}{E\{SS^*\} + E\{NN^*\}}$$

$$H_2 = \frac{w_2 E\{SS^*\} + w_4 E\{NN^*\}}{a^2 E\{SS^*\} + E\{NN^*\}},$$

wherein $E\{SS^*\}$ is a direct sound power information, wherein $E\{NN^*\}$ is a diffuse sound power information, wherein $w_1$ and $w_2$ are coefficients, which are dependent on the direction information, and wherein $w_3$ and $w_4$ are coefficients determined by diffuse sound gains; and wherein the filter is configured to determine a first channel signal $\hat{Y}_1(k,i)$ and a second channel signal $\hat{Y}_2(k,i)$ of the enhanced downmix signal in dependence on a first channel signal $X_1(k,i)$ and a second channel signal $X_2(k,i)$ of the multi-channel microphone signal according to $$\hat{Y}_1(k,i)=H_1(k,i)X_1(k,i)$$

$$\hat{Y}_2(k,i)=H_2(k,i)X_2(k,i).$$

9. The apparatus according to claim 1, wherein the filter calculator is configured to compute filter coefficients according to $$\begin{bmatrix} H_{1,1} \\ H_{1,2} \end{bmatrix} = \frac{1}{d}\begin{bmatrix} E\{X_2X_2^*\} & -E\{X_1X_2^*\} \\ -E\{X_2X_1^*\} & E\{X_1X_1^*\} \end{bmatrix}\begin{bmatrix} E\{X_1Y_1^*\} \\ E\{X_2Y_1^*\} \end{bmatrix}$$

$$\begin{bmatrix} H_{2,1} \\ H_{2,2} \end{bmatrix} = \frac{1}{d}\begin{bmatrix} E\{X_2X_2^*\} & -E\{X_1X_2^*\} \\ -E\{X_2X_1^*\} & E\{X_1X_1^*\} \end{bmatrix}\begin{bmatrix} E\{X_1Y_2^*\} \\ E\{X_2Y_2^*\} \end{bmatrix}$$

where, $$d = E\{X_1X_1^*\}E\{X_2X_2^*\} - E\{X_1X_2^*\}E\{X_2X_1^*\}.$$

wherein $X_1$ designates a first channel signal of the multi-channel microphone signal, $X_2$ designates a second channel signal of the multi-channel microphone signal, $E\{.\}$ designates a short-time averaging operation,

* designates a complex conjugate operation, $E\{X_1Y_1\}$, $E\{X_2Y_1^*\}$, $E\{X_1Y_2^*\}$ and $E\{X_2Y_2^*\}$ designate cross-correlation values between channel signals $X_1$, $X_2$ of the multi-channel microphone signal and desired channel signals $Y_1$, $Y_2$ of the enhanced downmix signal.

10. The apparatus according to claim 1, wherein the filter calculator is configured to calculate the enhancement filter parameters $H_{j,1}(k,i)$ to $H_{j,M}(k,i)$ such that channel signals $\hat{Y}_j(k,i)$ of the enhanced downmix signal acquired by filtering the channel signals of the multi-channel microphone signal in accordance with the enhancement filter parameters approximate, with respect to a statistical measure of similarity, desired channel signals $Y_j(k,i)$ defined as $$Y_j(k, i) = \sum_{l=0}^{K-1} m_{j,l} Z_l(k, i).$$

with $$Z_l(k, i) = g_l(k, i)\tilde{S}(k, i) + h_l(k, i)\tilde{N}_l(k, i).$$

wherein $g_l$ are gain factors, which are dependent on the direction information and which represent desired contributions of a direct sound component of the multi-channel microphone signal to a plurality of loudspeaker signals;

wherein $h_l$ are predetermined values describing desired contributions of a diffuse sound component of the multi-channel microphone signal to a plurality of loudspeaker signals.

11. The apparatus according to claim 1, wherein the filter calculator is configured to evaluate a Wiener-Hopf equation to derive the enhancement filter parameters, wherein the Wiener-Hopf equation describes a relationship between correlation values $E\{X_1X_1^*\}$, $E\{X_1X_2^*\}$, $E\{X_2X_1^*\}$, $E\{X_2X_2^*\}$, which correlation values describe a relationship between different channel pairs of the multi-channel microphone signal, enhancement filter parameters and desired cross-correlation values between channel signals of the multi-channel microphone signal and desired channel signals of the downmix signal.

12. The apparatus according to claim 1, wherein the filter calculator is configured to calculate the enhancement filter parameters in dependence on a model of desired downmix channels.

13. The apparatus according to claim 1, wherein the filter calculator is configured to selectively perform a single-channel filtering, in which a first channel of the enhanced downmix signal is derived by a filtering of a first channel of the multi-channel microphone signal and in which a second channel of the enhanced downmix signal is derived by a filtering of a second channel of the multi-channel microphone signal while avoiding a cross talk from the first channel of the multi-channel microphone signal to the second channel of the enhanced downmix signal and from the second channel of the multi-channel microphone signal to the first channel of the enhanced downmix signal, or a two-channel filtering in which a first channel of enhanced downmix signal is derived by filtering a first and a second channel of the multi-channel microphone signal, and in which a second channel of the enhanced downmix signal is derived by filtering a first and a second channel of the multi-channel microphone signal, in dependence on a correlation value describing a correlation between the first channel of the multi-channel microphone signal and the second channel of the multi-channel microphone signal.

14. A method for generating an enhanced downmix signal on the basis of a multi-channel microphone signal, the method comprising:

computing a set of spatial cue parameters comprising a direction information describing a direction-of-arrival of a direct sound, a direct sound power information and a diffuse sound power information on the basis of the multi-channel microphone signal;

calculating enhancement filter parameters in dependence on the direction information describing the direction-of-arrival of the direct sound, in dependence on the direct sound power information and in dependence on the diffuse sound power information; and filtering the microphone signal, or a signal derived therefrom, using the enhancement filter parameters, to acquire the enhanced downmix signal;

wherein the enhancement filter parameters are calculated in dependence on direction-dependent gain factors which describe desired contributions of a direct sound component of the multi-channel microphone signal to a plurality of loudspeaker signals and in dependence on one or more downmix matrix values which describe desired contributions of a plurality of audio channels to one or more channels of the enhanced downmix signal.

15. An apparatus for generating an enhanced downmix signal on the basis of a multi-channel microphone signal, the apparatus comprising:

a spatial analyzer configured to compute a set of spatial cue parameters comprising a direction information describing a direction-of-arrival of direct sound, a direct sound power information and a diffuse sound power information, on the basis of the multi-channel microphone signal;

a filter calculator for calculating enhancement filter parameters in dependence on the direction information describing the direction-of-arrival of the direct sound, in dependence on the direct sound power information and in dependence on the diffuse sound power information; and a filter for filtering the microphone signal, or a signal derived therefrom, using the enhancement filter parameters, to acquire the enhanced downmix signal;

wherein the filter calculator is configured to selectively perform a single-channel filtering, in which a first channel of the enhanced downmix signal is derived by a filtering of a first channel of the multi-channel microphone signal and in which a second channel of the enhanced downmix signal is derived by a filtering of a second channel of the multi-channel microphone signal while avoiding a cross talk from the first channel of the multi-channel microphone signal to the second channel of the enhanced downmix signal and from the second channel of the multi-channel microphone signal to the first channel of the enhanced downmix signal, or a two-channel filtering in which the first channel of the enhanced downmix signal is derived by filtering the first and the second channel of the multi-channel microphone signal, and in which the second channel of the enhanced downmix signal is derived by filtering the first and the second channel of the multi-channel microphone signal, in dependence on a correlation value describing a correlation between the first channel of the multi-channel microphone signal and the second channel of the multi-channel microphone signal.

16. A method for generating an enhanced downmix signal on the basis of a multi-channel microphone signal, the method comprising:

computing a set of spatial cue parameters comprising a direction information describing a direction-of-arrival of a direct sound, a direct sound power information and a diffuse sound power information on the basis of the multi-channel microphone signal;

calculating enhancement filter parameters in dependence on the direction information describing the direction-of-arrival of the direct sound, in dependence on the direct sound power information and in dependence on the diffuse sound power information; and filtering the microphone signal, or a signal derived therefrom, using the enhancement filter parameters, to acquire the enhanced downmix signal;

wherein the method comprises selectively performing a single-channel filtering, in which a first channel of the enhanced downmix signal is derived by a filtering of a first channel of the multi-channel microphone signal and in which a second channel of the enhanced downmix signal is derived by a filtering of a second channel of the multi-channel microphone signal while avoiding a cross talk from the first channel of the multi-channel microphone signal to the second channel of the enhanced downmix signal and from the second channel of the multi-channel microphone signal to the first channel of the enhanced downmix signal, or a two-channel filtering in which the first channel of the enhanced downmix signal is derived by filtering the first and the second channel of the multi-channel microphone signal, and in which the second channel of the enhanced downmix signal is derived by filtering the first and the second channel of the multi-channel microphone signal, in dependence on a correlation value describing a correlation between the first channel of the multi-channel microphone signal and the second channel of the multi-channel microphone signal.

17. A non-transitory computer-readable medium including a computer program for performing, when the computer program runs on a computer, a method for generating an enhanced downmix signal on the basis of a multi-channel microphone signal, the method comprising:

computing a set of spatial cue parameters comprising a direction information describing a direction-of-arrival of a direct sound, a direct sound power information and a diffuse sound power information on the basis of the multi-channel microphone signal;

calculating enhancement filter parameters in dependence on the direction information describing the direction-of-arrival of the direct sound, in dependence on the direct sound power information and in dependence on the diffuse sound power information; and filtering the microphone signal, or a signal derived therefrom, using the enhancement filter parameters, to acquire the enhanced downmix signal;

wherein the enhancement filter parameters are calculated in dependence on direction-dependent gain factors which describe desired contributions of a direct sound component of the multi-channel microphone signal to a plurality of loudspeaker signals and in dependence on one or more downmix matrix values which describe desired contributions of a plurality of audio channels to one or more channels of the enhanced downmix signal.

18. A non-transitory computer-readable medium including a computer program for performing, when the computer program runs on a computer, a method for generating an enhanced downmix signal on the basis of a multi-channel microphone signal, the method comprising:

computing a set of spatial cue parameters comprising a direction information describing a direction-of-arrival of a direct sound, a direct sound power information and a diffuse sound power information on the basis of the multi-channel microphone signal;

calculating enhancement filter parameters in dependence on the direction information describing the direction-of-arrival of the direct sound, in dependence on the direct sound power information and in dependence on the diffuse sound power information; and filtering the microphone signal, or a signal derived therefrom, using the enhancement filter parameters, to acquire the enhanced downmix signal;

wherein the method comprises selectively performing a single-channel filtering, in which a first channel of the enhanced downmix signal is derived by a filtering of a first channel of the multi-channel microphone signal and in which a second channel of the enhanced downmix signal is derived by a filtering of a second channel of the multi-channel microphone signal while avoiding a cross talk from the first channel of the multi-channel microphone signal to the second channel of the enhanced downmix signal and from the second channel of the multi-channel microphone signal to the first channel of the enhanced downmix signal, or a two-channel filtering in which the first channel of the enhanced downmix signal is derived by filtering the first and the second channel of the multi-channel microphone signal, and in which the second channel of the enhanced downmix signal is derived by filtering the first and the second channel of the multi-channel microphone signal, in dependence on a correlation value describing a correlation between the first channel of the multi-channel microphone signal and the second channel of the multi-channel microphone signal.

* * * * *